US005813344A

United States Patent [19]

Maruyama et al.

[11] Patent Number: 5,813,344

[45] Date of Patent: Sep. 29, 1998

[54] METHOD AND APPARATUS FOR REMOVING IMAGE FORMING SUBSTANCE FROM IMAGE HOLDING MEMBER

[75] Inventors: Tooru Maruyama, Fujisawa; Masatoshi Saitoh, Machida; Yasuhiro Takahashi, Tokyo; Shigeru Fujita, Machida, all of Japan

[73] Assignee: Ricoh Company, Ltd., Tokyo, Japan

[21] Appl. No.: 494,691

[22] Filed: Jun. 26, 1995

[30] Foreign Application Priority Data

| | | | |
|---|---|---|---|
| Oct. 24, 1994 | [JP] | Japan | 6-284424 |
| Jan. 9, 1995 | [JP] | Japan | 7-018548 |

[51] Int. Cl.[6] ..... B41F 35/00

[52] U.S. Cl. ..... 101/424; 101/483; 399/94; 399/346

[58] Field of Search ..... 101/424, 483, 101/487, 488, 424.1, 424.2, 491; 400/696, 695; 399/94, 346; 15/102

[56] References Cited

U.S. PATENT DOCUMENTS

| | | | |
|---|---|---|---|
| 3,656,948 | 4/1972 | Mammino | 96/1.4 |
| 5,400,123 | 3/1995 | Sato et al. | 355/218 |
| 5,489,158 | 2/1996 | Wang et al. | 400/695 |
| 5,568,986 | 10/1996 | Sugai | 400/695 |

FOREIGN PATENT DOCUMENTS

| | | | |
|---|---|---|---|
| 2951955 | 7/1981 | Germany | 400/696 |
| 50-56942 | 5/1975 | Japan . | |
| 51-100728 | 9/1976 | Japan . | |
| 54-27435 | 3/1979 | Japan . | |
| 55-30500 | 3/1980 | Japan . | |
| 55-154198 | 12/1980 | Japan . | |
| 57-114171 | 7/1982 | Japan . | |
| 57-125962 | 8/1982 | Japan . | |
| 57-125963 | 8/1982 | Japan . | |
| 57-190675 | 11/1982 | Japan . | |
| 58-105569 | 7/1983 | Japan . | |
| 59-2069 | 1/1984 | Japan . | |
| 59-33483 | 2/1984 | Japan . | |
| 59-89372 | 5/1984 | Japan . | |
| 59-93764 | 5/1984 | Japan . | |
| 59-98172 | 6/1984 | Japan . | |
| 60-133458 | 7/1985 | Japan . | |
| 60-182465 | 9/1985 | Japan . | |
| 60-193691 | 10/1985 | Japan . | |
| 60-230899 | 11/1985 | Japan . | |
| 61-213185 | 9/1986 | Japan . | |
| 61-237684 | 10/1986 | Japan . | |
| 62-14163 | 1/1987 | Japan . | |
| 62-102270 | 5/1987 | Japan . | |
| 62-203190 | 9/1987 | Japan . | |
| 62-212187 | 9/1987 | Japan . | |
| 62-199767 | 12/1987 | Japan . | |
| 63-39377 | 2/1988 | Japan . | |
| 63-73282 | 4/1988 | Japan . | |
| 63-140577 | 9/1988 | Japan . | |

(List continued on next page.)

*Primary Examiner*—Edgar S. Burr
*Assistant Examiner*—Anthony H. Nguyen
*Attorney, Agent, or Firm*—Oblon, Spivak, McClelland, Maier & Neustadt, P.C.

[57] ABSTRACT

In a method and an apparatus for removing an image forming substance such as toner from an image holding member such as a sheet of transfer paper, a liquid providing unit is constructed by plural coating devices such as three coating devices each having a coating roller, a restricting roller and a liquid container for liquid storage. The coating devices are arranged along a conveying path of the transfer paper sheet. A liquid is provided to the transfer paper sheet from both face sides thereof by using a mist generator, etc. in the liquid providing unit. The coating and restricting rollers are arranged such that no coating and restricting rollers come in contact with the transfer paper sheet so as not to restrict the transfer paper sheet. A surface of each of the coating and restricting rollers is desirably constructed such that this surface is hydrophilic. Another toner removing apparatus is also shown. A drive roller device for supporting an offset belt for conveying the transfer paper sheet is also shown.

37 Claims, 11 Drawing Sheets

FOREIGN PATENT DOCUMENTS

| | | |
|---|---|---|
| 1-101576 | 4/1989 | Japan . |
| 1-101577 | 4/1989 | Japan . |
| 1-137266 | 5/1989 | Japan . |
| 1-145680 | 6/1989 | Japan . |
| 1-297294 | 11/1989 | Japan . |
| 2-11400 | 1/1990 | Japan . |
| 2-3400 | 1/1990 | Japan . |
| 2-3876 | 1/1990 | Japan . |
| 2-19568 | 2/1990 | Japan . |
| 2-55195 | 2/1990 | Japan . |
| 2-59926 | 2/1990 | Japan . |
| 2-62277 | 3/1990 | Japan . |
| 2-111987 | 4/1990 | Japan . |
| 2-188293 | 7/1990 | Japan . |
| 2-188294 | 7/1990 | Japan . |
| 2-117547 | 9/1990 | Japan . |
| 2-227299 | 9/1990 | Japan . |
| 3-116594 | 5/1991 | Japan . |
| 3-218898 | 9/1991 | Japan . |
| 3-249661 | 11/1991 | Japan . |
| 4-22968 | 1/1992 | Japan . |
| 4-57070 | 2/1992 | Japan . |
| 4-64472 | 2/1992 | Japan . |
| 4-64473 | 2/1992 | Japan . |
| 4-67043 | 3/1992 | Japan . |
| 4-82983 | 3/1992 | Japan . |
| 4-89271 | 3/1992 | Japan . |
| 4-91298 | 3/1992 | Japan . |
| 4-126900 | 4/1992 | Japan . |
| 4-234056 | 8/1992 | Japan . |
| 4-118499 | 10/1992 | Japan . |
| 4-118500 | 10/1992 | Japan . |
| 4-281096 | 10/1992 | Japan . |
| 4-300395 | 10/1992 | Japan . |
| 4-327299 | 11/1992 | Japan . |
| 4-333088 | 11/1992 | Japan . |
| 4-333699 | 11/1992 | Japan . |
| 4-356085 | 12/1992 | Japan . |
| 4-356086 | 12/1992 | Japan . |
| 4-356087 | 12/1992 | Japan . |
| 4-356088 | 12/1992 | Japan . |
| 4-356089 | 12/1992 | Japan . |
| 4-362935 | 12/1992 | Japan . |
| 5-2356 | 1/1993 | Japan . |
| 5-32926 | 2/1993 | Japan . |
| 5-61382 | 3/1993 | Japan . |
| 5-127571 | 5/1993 | Japan . |
| 5-148435 | 6/1993 | Japan . |
| 5-173454 | 7/1993 | Japan . |
| 5-197315 | 8/1993 | Japan . |
| 5-216374 | 8/1993 | Japan . |
| 5-216375 | 8/1993 | Japan . |
| 5-216376 | 8/1993 | Japan . |
| 5-221128 | 8/1993 | Japan . |
| 5-232737 | 9/1993 | Japan . |
| 5-232738 | 9/1993 | Japan . |
| 5-246115 | 9/1993 | Japan . |
| 5-297766 | 11/1993 | Japan . |
| 5-323831 | 12/1993 | Japan . |
| 5-323832 | 12/1993 | Japan . |
| 6-11938 | 1/1994 | Japan . |
| 6-19181 | 1/1994 | Japan . |
| 6-8623 | 1/1994 | Japan . |
| 6-8626 | 1/1994 | Japan . |
| 6-13651 | 2/1994 | Japan . |
| 6-13652 | 2/1994 | Japan . |
| 6-27710 | 2/1994 | Japan . |
| 6-27735 | 2/1994 | Japan . |
| 6-27736 | 2/1994 | Japan . |
| 6-27737 | 2/1994 | Japan . |
| 6-27738 | 2/1994 | Japan . |
| 6-27739 | 2/1994 | Japan . |
| 6-43682 | 2/1994 | Japan . |
| 6-51669 | 2/1994 | Japan . |
| 6-67576 | 3/1994 | Japan . |
| 6-91987 | 4/1994 | Japan . |
| 6-143745 | 5/1994 | Japan . |
| 6-143746 | 5/1994 | Japan . |
| 6-143807 | 5/1994 | Japan . |
| 6-155776 | 6/1994 | Japan . |
| 6-155858 | 6/1994 | Japan . |
| 6-155906 | 6/1994 | Japan . |
| 6-161326 | 6/1994 | Japan . |
| 6-175538 | 6/1994 | Japan . |
| 6-206358 | 7/1994 | Japan . |
| 6-208317 | 7/1994 | Japan . |
| 6-208318 | 7/1994 | Japan . |
| 6-270431 | 9/1994 | Japan . |
| 6-279721 | 10/1994 | Japan . |
| 6-286176 | 10/1994 | Japan . |
| 6-286177 | 10/1994 | Japan . |
| 6-286312 | 10/1994 | Japan . |
| 6-295142 | 10/1994 | Japan . |
| 6-297810 | 10/1994 | Japan . |
| 6-299106 | 10/1994 | Japan . |
| 6-308761 | 11/1994 | Japan . |
| 6-308823 | 11/1994 | Japan . |
| 6-308860 | 11/1994 | Japan . |
| 6-308861 | 11/1994 | Japan . |
| 6-332239 | 12/1994 | Japan . |
| 6-332340 | 12/1994 | Japan . |

METHOD AND APPARATUS FOR REMOVING IMAGE FORMING SUBSTANCE FROM IMAGE HOLDING MEMBER

BACKGROUND OF THE INVENTION

1. Field of the Invention

The present invention relates to an apparatus for removing an image forming substance from an image holding member onto which the image forming substance is stably attached by an image forming apparatus such as a copying machine, a facsimile telegraph, a printer, etc. More particularly, the present invention relates to prevention of wavy deformation of an image holding member caused by liquid absorption in a method and an apparatus for removing an image forming substance from the image holding member in which the image holding member attaching the image forming substance on its surface has a liquid absorbing property in at least a surface portion thereof and an unstabilizing liquid for unstabilizing attachment of this surface and the image forming substance is provided to the image holding member, and the image forming substance is removed from the image holding member by using a predetermined separating member.

The present invention also relates to an image forming substance removing apparatus and a sheet material processor for removing an image forming substance from a sheet material onto which the image forming substance is stably attached by an image forming apparatus such as a copying machine, a facsimile telegraph, a printer, etc. More particularly, the present invention relates to an image forming substance removing apparatus and a sheet material processor in which a member for liquid supply having a liquid on its surface is endlessly moved at a speed higher than a moving speed of a sheet material in a direction parallel to a conveying direction of the sheet material so as to supply a desirable amount of liquid to the sheet material, and it is possible to prevent the sheet material from being folded and prevent a liquid supplying amount from being insufficient by rapid traverse of a rear end of the sheet material by this high speed endless movement.

The present invention further relates to a drive roller device having a drive roller driven by a driving source from the exterior thereof. More particularly, the present invention relates to a drive roller device in which a clutch structure for coupling and uncoupling this drive roller and the external driving source is improved.

2. Description of the Related Art

There are generally various kinds of known methods and apparatuses for removing an image forming substance such as toner from a sheet of paper as a recorded image holding member. For example, Japanese Patent Application Laying Open (KOKAI) No. 1-101576 shows an image forming substance removing method using a solvent. In this image forming substance removing method, a sheet of paper attaching toner thereon is dipped into a soluble solvent of toner resin and a supersonic wave is vibrated in this paper sheet so that the toner dissolved into the solvent is separated from a paper face. Japanese Patent Application Laying Open (KOKAI) No. 4-300395 shows another image forming substance removing method. In this method, a solvent is attached to a printed sheet portion of used paper by a method of dipping, spraying or coating, etc. so that toner is dissolved. The dissolved toner is removed from the paper sheet by a method of cleaning, air suction, absorbent contact, mechanical separation or electrostatic absorption, etc.

For example, Japanese Patent Application Laying Open (KOKAI) No. 2-55195 shows an image forming substance removing method in which no solvent is used. In this method, thermally melted ink or toner is attached by an electrophotographic system or a thermal transfer system onto a printing member in which a supporting member is coated with a mold releasing agent. An ink separating member is overlapped with the printing member and these members are transmitted between a heating roller and a pressure roller. The ink separating member is separated from the printing member after the ink separating member is cooled. Thus, the ink or toner is attached onto the ink separating member so that the ink or toner is removed from the printing member. Japanese Patent Application Laying Open (KOKAI) No. 4-64472 shows an eraser comprising at least an endless sheet having thermally melted resin on its surface, a heating roller and a cooling roller for supporting and rotating the endless sheet, a pressing roller for pressing a sheet of erasable paper mold-released on its surface against thermally softened or melted resin, and a driving section for operating these members in association with each other. Japanese Patent Application Laying Open (KOKAI) No. 4-82983 shows an image forming substance removing apparatus comprising two parallel rollers coming in press contact with each other and rotated to pass a paper sheet through a press contact portion, a heater for heating at least one of these two rollers, a scraper for separating the paper sheet passing through the press contact portion from these rollers, and a separator for removing an image forming substance attached onto these rollers therefrom.

Each of the above methods and apparatuses using no solvent is used to remove the image forming substance from the recorded image holding member in which an image is recorded on a sheet of normal paper having paper fibers exposed onto a paper surface. In this case, for example, the image forming substance having thermally melted resin as a principal component is melted and attached onto the image holding member in a fixing process in the electrophotographic system. Accordingly, the image forming substance is strongly fixed to paper fibers on a surface of the image holding member. Therefore, when the image forming substance is removed, paper fibers on the image holding member surface are removed therefrom together with the image forming substance so that the image holding member is damaged and a paper quality is reduced. In particular, when the image holding member is heated and pressurized through the above ink separating member, the endless sheet or the above rollers to improve removal of the image forming substance, a fixing property between the image forming substance and the image holding member is conversely increased in various kinds of conditions so that it is difficult to remove the image forming substance from the image holding member.

For example, the inventors in this patent application proposed an image forming substance removing method in Japanese-Patent Application No. 4-255916. In this method, at least one kind of water or aqueous solution is selected from a group of water as an unstabilizing agent, an aqueous solution including a surfactant, an aqueous solution including a water-soluble polymer, and an aqueous solution including a surfactant and a water-soluble polymer. This selected water or aqueous solution is held in a recorded image holding member. An image forming substance is heated and adhered to a separating member. Otherwise, the image forming substance is pressurized and adhered to the separating member. The image forming substance is separated from the image holding member through the separating member. In this method, only the image forming substance can be removed from the image holding member without relatively damaging a paper quality of the image holding member.

However, in the above proposed method for removing the image forming substance from the image holding member in Japanese Patent Application No. 4-255916, it is confirmed that the image holding member removing the image forming substance therefrom is deformed in a wavy shape and is deformed with wrinkles. It is found from our research that this wavy shape and these wrinkles are caused by absorption of a predetermined liquid into the image holding member. For example, in an example shown in FIG. 7*a*, a liquid is provided to a sheet of transfer paper 10 as an image holding member by a coating roller 33 partially dipping and rotating in a surfactant aqueous solution within a liquid container 32 when the paper sheet 10 passes through the coating roller 33 and a restricting roller 34 for restricting upward and downward movements of the paper sheet. A paper portion absorbing this supplied liquid (shown by reference numeral A in FIG. 7*a*) thereinto is deformed in a wavy shape. When this wavy deformation caused by the liquid absorption is finally left and the transfer paper sheet passes through a conveying roller pair for conveying the image holding member, etc. in a deforming state, this deformation causes wrinkles, etc. An arrow B in FIG. 7*a* shows a feeding direction of the transfer paper sheet 10.

For example, in Japanese Patent Application No. 4-255916, the inventors of this patent application proposed another image forming substance removing method. In this removing method, at least one kind of water or aqueous solution is selected from a group of water as an unstabilizing agent, an aqueous solution including a surfactant, an aqueous solution including a water-soluble polymer, and an aqueous solution including a surfactant and a water-soluble polymer. This selected water or aqueous solution is held in a recorded sheet material. An image forming substance is heated and adhered to a separating member. Otherwise, the image forming substance is pressurized and adhered to the separating member. The image forming substance is then separated from the sheet material through the separating member. In this removing method, only the image forming substance can be removed from the sheet material without relatively damaging the sheet material and reducing a paper quality of the sheet material.

To embody the above proposed method, it is considered that a desirable amount of liquid is supplied to the sheet material by endlessly moving a liquid supplying member having a liquid on its surface at a speed higher than a moving speed of the sheet material in a direction parallel to a conveying direction of the sheet material. However, when such a liquid supplying member is used, a sheet rear end is arranged on an upstream side from the liquid supplying member in the conveying direction of the sheet material. The sheet material is separated from a supporting-conveying device for conveying the sheet material in a supporting state in a thickness direction thereof. Thereafter, a rear end portion of the sheet material is rapidly fed by rapid traverse using the above liquid supplying member. Accordingly, there is a fear of folding the sheet material and a fear of an insufficient liquid supplying amount.

Therefore, the inventors of this patent application proposed an image forming substance removing apparatus and a sheet material processor in Japanese Patent Application No. 5-201174. In this image forming substance removing apparatus and this sheet material processor, an operation of the liquid supplying member is controlled such that a surface of the liquid supplying member is moved in a direction opposite to that of the sheet material in a period in which the sheet material is opposed to the above liquid supplying member and a rear end portion of the sheet material is separated from its supporting state provided by the above upstream supplying-conveying device.

A drive roller device of the above kind is used in various kinds of machines. For example, this drive roller device is used as a drive roller device for conveying a sheet of paper and a drive roller device for supporting and rotating a belt for conveying a sheet of paper. Each of these drive roller devices is arranged in an image forming apparatus such as a copying machine, a facsimile telegraph, a printer, etc. and an image forming substance removing apparatus for removing an image forming substance forming an image from an image holding member on which the image is formed by such an image forming apparatus. In the drive roller device arranged in a conveyer for conveying a sheet of paper within the image forming apparatus, etc., a drive roller and the drive source such as a motor within the image forming apparatus, etc. are uncoupled from each other and the drive roller can be manually rotated to perform jam processing, etc. when a paper jam is caused within the image forming apparatus.

FIG. 1 shows one example of this drive roller device. A drive roller 410 in this example is arranged between sides plates of the drive roller device and both shaft portions of the drive roller are supported by bearings. One of the shaft portions extends outside one side plate. A roller side gear 411 is fixed to this extending shaft portion. A slide shaft 412 is attached to the side plates therebetween such that the slide shaft 412 is close to the drive roller 410 and is parallel to this drive roller 410. A slide gear 413 is fixed to a portion of this slide shaft extending from the one side plate and is engaged with the above roller side gear 411. A driven coupling member 415 is fixed onto a further end portion side from this slide gear 413. The driven coupling member 415 can be coupled to a drive coupling member 414 as a driving input member driven by an unillustrated motor of a device body. Teeth portions of both the gears 413 and 414 are formed such that the slide gear 413 and the roller side gear 411 are engaged with each other at any time within a sliding range of the slide shaft 412 restricted by the side plates and the drive coupling member 414. The drive coupling member 414 and the driven coupling member 415 are coupled to each other in a state in which the slide shaft 412 is slid on a rightmost side in FIG. 1. The drive coupling member 414 and the driven coupling member 415 are uncoupled from each other in a state in which the slide shaft 412 is slid on a left-hand side in FIG. 1.

In the above construction, the slide shaft is located in a rightmost moving position in FIG. 1 in a normal state in which the drive roller 410 can be rotated by the motor of the device body, etc. In this normal state, the drive coupling member 414 and the driven coupling member 415 are coupled to each other, and the slide gear 413 and the roller side gear 411 are coupled to each other. Rotation of the drive coupling member 414 is transmitted to a drive roller shaft through the driven coupling member 415, the slide shaft 412, the slide gear 413 and the roller side gear 411. Thus, the drive roller 410 can be rotated. When the drive roller 410 is manually rotated, the slide shaft 412 is slid on the left-hand side in FIG. 1 to uncouple the drive coupling member 414 and the driven coupling member 415 from each other. The slide shaft 412 is manually rotated in a state in which an operator grips an unillustrated knob, etc. fixed to a left-hand side end portion of the slide shaft 412 in FIG. 1. This rotation of the slide shaft 412 is transmitted to the drive roller shaft through the slide gear 413 and the roller side gear 411. Thus, the drive roller 410 can be manually rotated.

In this example of FIG. 1, the slide shaft 412 is arranged in the vicinity of the drive roller 410. Accordingly, the drive roller device is large-sized by an arrangement of this slide shaft 412 in cross section perpendicular to the drive roller shaft.

The drive roller device may be constructed such that the slide shaft 412 and the drive roller 410 are not separated from each other. In this case, the driven coupling member 415 is directly fixed to a shaft end portion of the drive roller 410. Further, the drive roller 410 is supported by the side plates of the drive roller device such that the drive roller 410 can be slid. The driven coupling member 415 and the drive coupling member 414 on the device body side are coupled and uncoupled from each other by sliding this drive roller 410 itself. However, in the image forming apparatus, a pressurizing roller comes in press contact with the drive roller such as a fixing roller and the drive roller has a large load in a sliding movement. Further, in the case of a belt-supporting drive roller, a belt is wound around the belt-supporting drive roller so that a load in a sliding movement of this drive roller is large. Accordingly, with respect to such drive rollers, it is difficult to use the above construction in which the slide shaft 412 and the drive roller 410 are not separated from each other. There is a known structure in which a shaft end portion of the drive roller 410 is directly connected onto a motor side through a one-way clutch. However, such a clutch cannot be used in a drive roller device in which the pressurizing roller comes in press contact with the drive roller such as the fixing roller and a rotating load of the drive roller at a manual rotating time thereof is large.

SUMMARY OF THE INVENTION

It is therefore a first object of the present invention to provide a method and an apparatus for removing an image forming substance from an image holding member in which the image holding member attaching the image forming substance on its surface has a liquid absorbing property in at least a surface portion thereof and an unstabilizing liquid for unstabilizing attachment of this surface and the image forming substance is provided to the image holding member, and the image forming substance is removed from the image holding member by using a predetermined separating member so that the image forming substance can be preferably removed from the image holding member and wavy deformation and wrinkles of the image holding member can be reduced after the image forming substance is removed from the image holding member.

A second object of the present invention is to provide an image forming substance removing apparatus and a sheet material processor in which plural liquid supplying members are arranged along a conveying path of a sheet material and problems caused by rapid traverse of a rear end of the sheet material using each of the liquid supplying members, etc. can be solved.

In accordance with a first construction of the present invention, the above first object can be achieved by a method for removing an image forming substance from an image holding member in which the image forming substance is attached to a surface of the image holding member and at least a surface portion of the image holding member has a liquid absorbing property;

an unstabilizing liquid for unstabilizing the attachment of the surface of the image holding member and the image forming substance is provided to the image holding member;

a separating member has adhesive force stronger than that of the surface of the image holding member with respect to the image forming substance and comes in contact with the image forming substance on the surface of the image holding member; and the separating member is then separated from the surface of the image holding member so that the image forming substance is separated and removed from the surface of the image holding member;

the image forming substance removing method comprising the steps of:

dividing a predetermined amount of the unstabilizing liquid into plural amounts and providing the divided unstabilizing liquid to the image holding member.

It is desirable to use an unstabilizing liquid in which no image forming substance is dissolved such that no image holding member is dirtied by dissolution of the image forming substance, etc. For example, general toner for electrophotography is hydrophobic. Accordingly, the unstabilizing liquid is desirably constructed by using water, an aqueous solution of a surfactant, an aqueous solution including a surfactant and a water-soluble polymer, etc. to remove the toner from the image holding member.

In accordance with a second construction of the present invention, the above first object can be also achieved by an apparatus for removing an image forming substance from an image holding member in which the image forming substance is attached to a surface of the image holding member and at least a surface portion of the image holding member has a liquid absorbing property, the removing apparatus comprising:

unstabilizing liquid providing means for dividing a predetermined amount of unstabilizing liquid for unstabilizing the attachment of the surface of the image holding member and the image forming substance into plural amounts and providing this divided unstabilizing liquid to the image holding member; and image forming substance separating means in which a separating member has adhesive force stronger than that of the surface of the image holding member with respect to the image forming substance and comes in contact with the image forming substance on the surface of the image holding member; and the separating member is then separated from the surface of the image holding member.

In accordance with a third construction of the present invention, the unstabilizing liquid providing means in the second construction has plural sets of coating rollers and restricting rollers. Each of the coating rollers forms a liquid film constructed by the above unstabilizing liquid on its surface and provides this liquid film to the image holding member. Each of the restricting rollers is opposed to each of the coating rollers through the image holding member and restricts a movement of the image holding member in a thickness direction thereof.

In accordance with a fourth construction of the present invention, the unstabilizing liquid providing means in the second construction is constructed by using a supersonic wave oscillating member for changing the unstabilizing liquid to a mist and providing this unstabilizing liquid to the image holding member.

In accordance with a fifth construction of the present invention, the image forming substance removing apparatus having the fourth construction further comprises image holding member moving means for relatively moving the image holding member with respect to a mist generating portion of the supersonic wave oscillating member, and comprises supersonic wave oscillating control means for starting oscillation of the supersonic wave oscillating member when the image holding member approaches this mist generating portion.

In accordance with a sixth construction of the present invention, the unstabilizing liquid providing means in the second construction is constructed such that the unstabilizing liquid is provided to the image holding member from both front and rear face sides thereof.

In accordance with a seventh construction of the present invention, an amount of the unstabilizing liquid provided to the image holding member at one time by the unstabilizing liquid providing means in the second construction is set to an amount determined to such an extent that no wavy deformation is caused in the image holding member.

In accordance with an eighth construction of the present invention, an aqueous solution including at least a surfactant is used as the unstabilizing liquid in the second construction. Further, surfactant concentrations of the unstabilizing liquid provided by the unstabilizing liquid providing means are set to be different from each other at respective providing times of the unstabilizing liquid.

In accordance with a ninth construction of the present invention, the coating rollers and the restricting rollers in the third construction are arranged such that the coating and restricting rollers are opposed to each other at predetermined intervals. Further, surfaces of both the coating and restricting rollers are constructed by a material having an affinity for the unstabilizing liquid.

In the present invention, the image forming substance is attached to a surface of the image holding member and at least a surface portion of the image holding member has a liquid absorbing property. The unstabilizing liquid is provided to the image holding member to unstabilize the attachment of the surface of the image holding member and the image forming substance. A predetermined separating member comes in contact with the image forming substance on the surface of the image holding member so that the image forming substance is attached onto a surface of the separating member. Thereafter, while the image forming substance is attached onto the separating member, the separating member is separated from the surface of the image holding member so that the image forming substance is separated and removed from the surface of the image holding member.

Wavy deformation is caused by this provision of the unstabilizing liquid in the image holding member having a liquid absorbing property in at least a surface portion thereof. In accordance with a research of the inventors of this patent application, as shown in FIG. 7*b*, a transfer paper sheet 10 approximately extends by 1.5% in an X-direction, 3% in a Y-direction and 50% in a Z-direction by liquid absorption. In this case, the X-direction is set to the same direction as a feeding direction B of the transfer paper sheet 10. The Y-direction is set to a direction perpendicular to the X-direction. The Z-direction is set to a thickness direction of the transfer paper sheet perpendicular to the X-direction. When the transfer paper sheet extends by this liquid absorption, wavy deformation is caused in a boundary portion 10*d* between a liquid unabsorbing portion 10*c* and a liquid absorbing portion 10*b* extending by the liquid absorption as shown in FIG. 8 when the liquid unabsorbing portion 10*c* and the liquid absorbing portion 10*b* exist within the same transfer paper sheet. This wavy deformation is probably caused since the extension of the liquid absorbing portion 10*b* is prevented by the liquid unabsorbing portion 10*c*. The extension of the transfer paper sheet caused by the liquid absorption is approximately proportional to a liquid absorbing amount of the transfer paper sheet. Accordingly, if the liquid absorbing amount is small, an extending amount of the transfer paper sheet caused by the liquid absorption is also small. In this case, a difference in extension between the liquid absorbing portion 10*b* and the liquid unabsorbing portion 10*c* is small so that the above wavy deformation can be restricted.

Therefore, in the present invention, an amount of the unstabilizing liquid according to the liquid absorbing amount of the image holding member required to preferably remove the image forming substance therefrom is divided into plural amounts. In this case, the amount of the unstabilizing liquid is set to be equal to or greater than at least the liquid absorbing amount of the image holding member. The divided unstabilizing liquid is provided to the image holding member. Thus, the wavy deformation of the image holding member can be reduced in comparison with wavy deformation caused when a required amount of the unstabilizing liquid is provided to the image holding member at one time.

In accordance with a tenth construction of the present invention, the above second object can be achieved by an apparatus for removing an image forming substance from a surface of a sheet material on which the image forming substance is fixed;

the removing apparatus comprising:

first and second supporting conveyers arranged at a predetermined interval along a conveying path of the sheet material and supporting the sheet material in a thickness direction thereof and conveying the sheet material in a predetermined direction;

a liquid supplying device having plural liquid supplying members each arranged between the first and second supporting conveyers in the conveying path and carrying a liquid on its surface;

the liquid supplying members being operated such that each of the liquid supplying members is endlessly moved selectively in a direction parallel to a conveying direction of the sheet material using the first and second supporting conveyers and a direction opposite to this conveying direction;

liquid supplying member driving control means constructed such that each of the plural liquid supplying members is endlessly moved in a predetermined period at a speed higher than a moving speed of the sheet material in the direction parallel to the conveying direction, and each of the plural liquid supplying members is endlessly moved in the direction opposite to the conveying direction in at least a period corresponding to a liquid supplying member opposed to a rearmost end portion of the sheet material among liquid supplying members for providing conveying force to the sheet material conveyed in the predetermined direction; and image forming substance removing means for removing the image forming substance from the sheet material to which the liquid is supplied by the liquid supplying device.

In accordance with an eleventh construction of the present invention, the liquid supplying member driving control means in the tenth construction is constructed such that each of the plural liquid supplying members is endlessly moved at a speed higher than the moving speed of the sheet material in the direction parallel to the conveying direction in at least a period corresponding to a liquid supplying member opposed to a frontmost end portion of the sheet material among liquid supplying members for providing conveying force to the sheet material conveyed in the predetermined direction.

In accordance with a twelfth construction of the present invention, the liquid supplying member driving control means in the tenth or eleventh construction is constructed such that the endless movement of each of the plural liquid supplying members is started before a front end of the sheet material is opposed to a surface of each of the plural liquid supplying members.

In accordance with a thirteenth construction of the present invention, the above second object can be also achieved by a sheet material processor for supplying a liquid to a sheet material and performing predetermined processing with respect to this sheet material;

the sheet material processor comprising:

first and second supporting conveyers arranged at a predetermined interval along a conveying path of the sheet material and supporting the sheet material in a thickness direction thereof and conveying the sheet material;

a liquid supplying device having plural liquid supplying members each arranged between the first and second supporting conveyers in the conveying path and carrying a liquid on its surface;

the liquid supplying members being operated such that each of the liquid supplying members is endlessly moved selectively in a direction parallel to a conveying direction of the sheet material using the first and second supporting conveyers and a direction opposite to this conveying direction; and liquid supplying member driving control means constructed such that each of the plural liquid supplying members is endlessly moved in a predetermined period at a speed higher than a moving speed of the sheet material in the direction parallel to the conveying direction, and each of the plural liquid supplying members is endlessly moved in the direction opposite to the conveying direction in at least a period corresponding to a liquid supplying member opposed to a rearmost end portion of the sheet material among liquid supplying members for providing conveying force to the sheet material conveyed in a predetermined direction.

In accordance with a fourteenth construction of the present invention, the liquid supplying member driving control means in the thirteenth construction is constructed such that each of the plural liquid supplying members is endlessly moved at a speed higher than the moving speed of the sheet material in the direction parallel to the conveying direction in at least a period corresponding to a liquid supplying member opposed to a frontmost end portion of the sheet material among liquid supplying members for providing conveying force to the sheet material conveyed in the predetermined direction.

In the present invention, each of the plural liquid supplying members is arranged along the conveying path of the sheet material and carries a liquid on its surface and is endlessly moved. Each of the plural liquid supplying members is endless moved in at least a predetermined period at a speed higher than a moving speed of the sheet material in a direction parallel to the conveying direction of the sheet material. Thus, a sufficient amount of liquid is preferably supplied to the sheet material by the plural liquid supplying members without causing liquid cutting, etc. between the sheet material and each of the liquid supplying members, etc. Each of the liquid supplying members is endlessly moved in a direction opposite to the above conveying direction in at least a period in which there is a fear of rapid traverse of a rear end portion of the sheet material. This period corresponds to a liquid supplying member opposed to a rearmost end portion of the sheet material among liquid supplying members providing conveying force to the sheet material conveyed in a predetermined direction. Thus, it is possible to prevent the sheet material from being folded and the supplied liquid amount from being insufficient by the rapid traverse.

In the present invention, each of the plural liquid supplying members is desirably endlessly moved at a speed higher than the moving speed of the sheet material in the direction parallel to the conveying direction in at least a period in which there is a fear of feeding a front end portion of the sheet material onto an upstream side in the conveying direction in the endless movement in the above opposite direction. This period corresponds to a liquid supplying member opposed to a frontmost end portion of the sheet material among liquid supplying members for providing conveying force to the sheet material conveyed in the predetermined direction. Thus, it is possible to prevent the sheet material from being folded and jammed by feeding the front end portion of the sheet material onto the upstream side in the conveying direction in the endless movement in the above opposite direction.

Further, in the present invention, the endless movement of each of the plural liquid supplying members is desirably started before a front end of the sheet material is opposed to a surface of each of the plural liquid supplying members. In this case, it is possible to prevent the sheet material from being opposed to the surface of each of the liquid supplying members and prevent the liquid from being irregularly provided to the sheet material in a period in which no liquid film is stabilized on the surface of each of the liquid supplying members just after the endless movement of each of the liquid supplying members is started.

Further objects and advantages of the present invention will be apparent from the following description of the preferred embodiments of the present invention as illustrated in the accompanying drawings.

Figure 1:
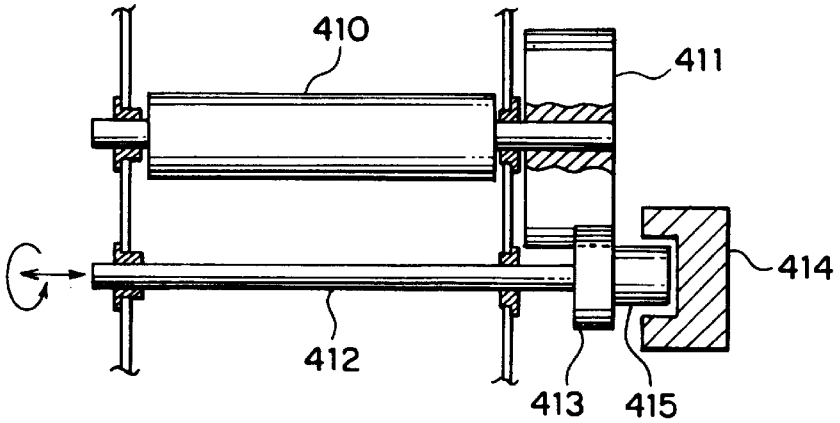
FIG. 1 is a view showing the schematic construction of a drive roller device as a general example.
Figure 3A:
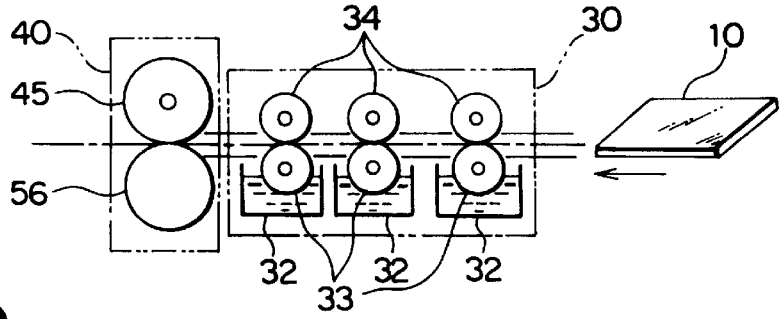
Figure 3B:
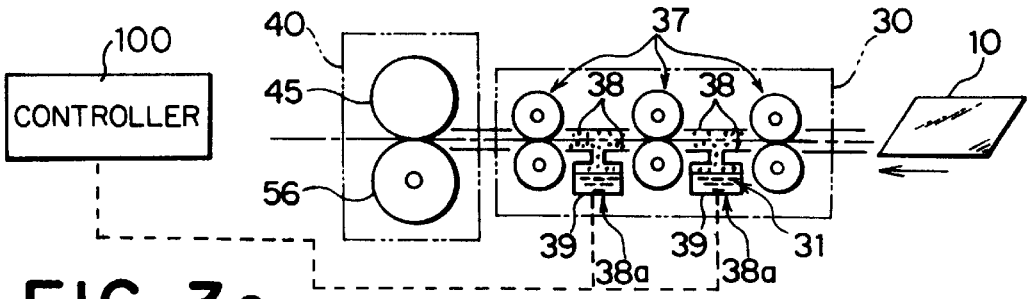
Figure 3C:
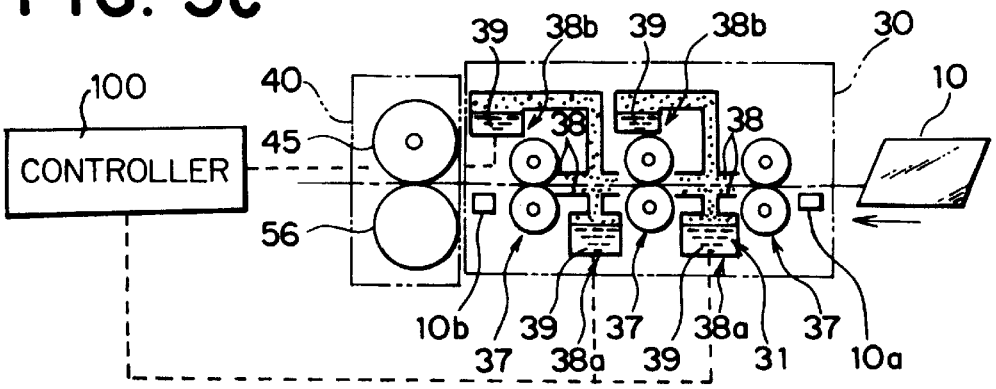
Figure 4:
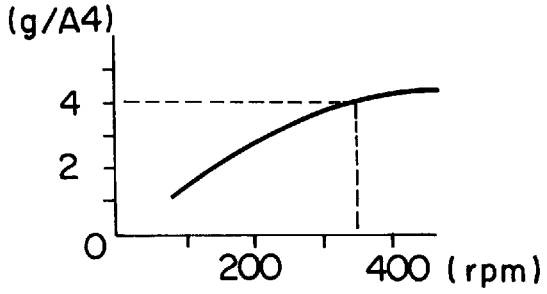
Figure 5:
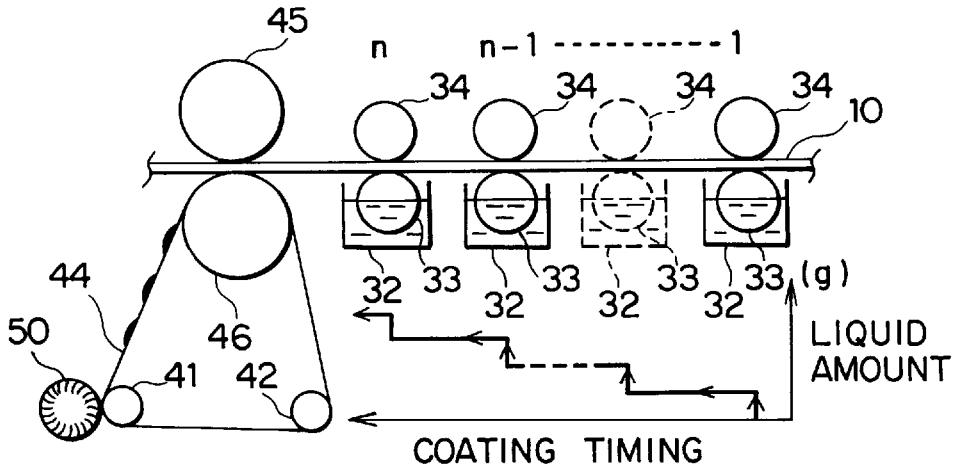
Figure 6:
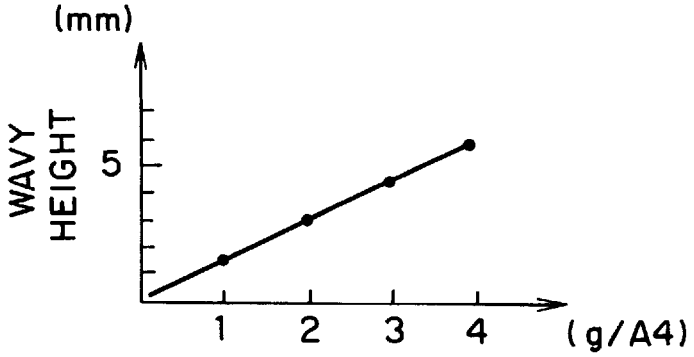
Figure 7A:
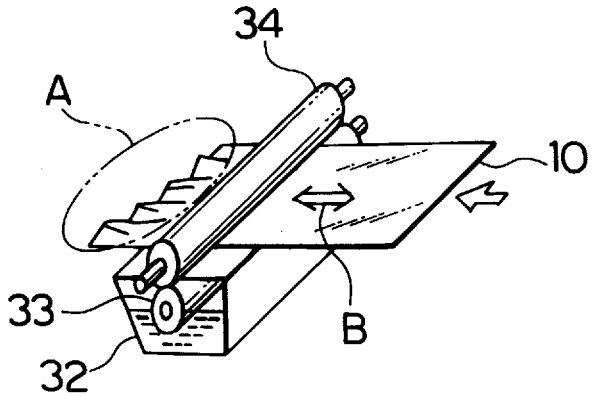
Figure 7B:
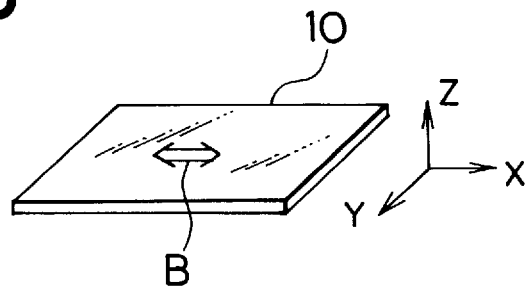
Figure 8:
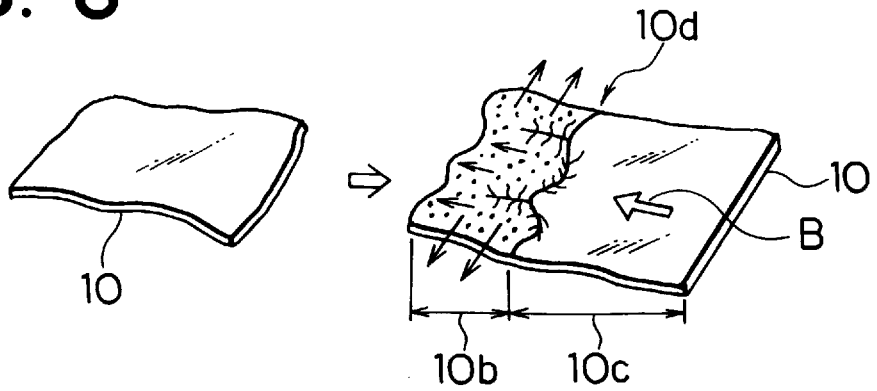
Figure 9:
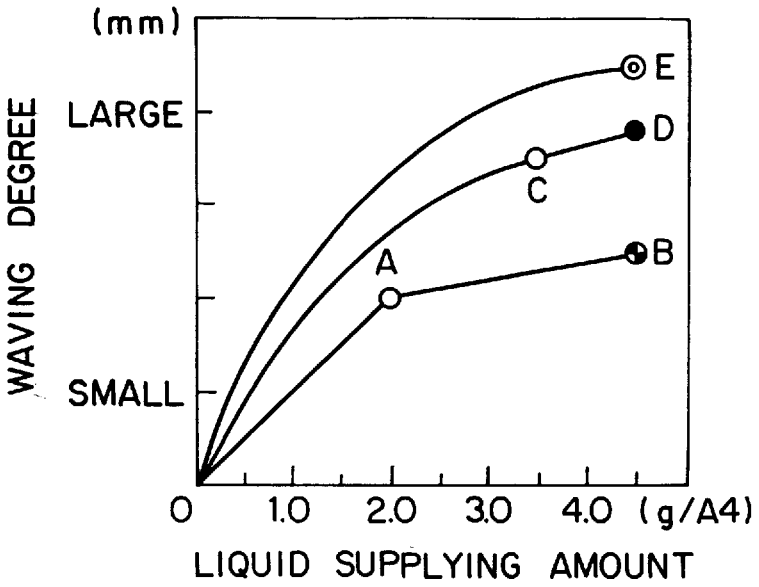
Figure 10:
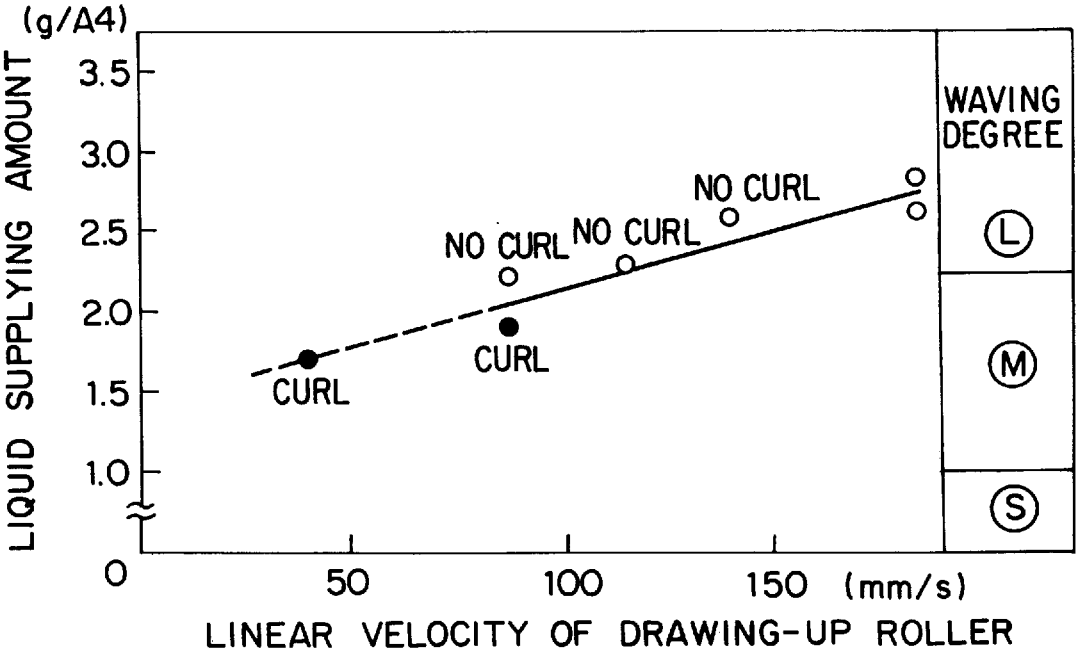
Figure 11A:
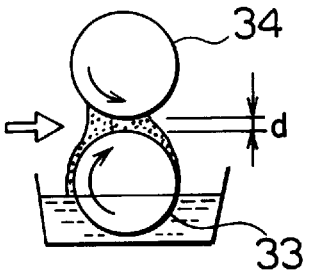
Figure 11B:
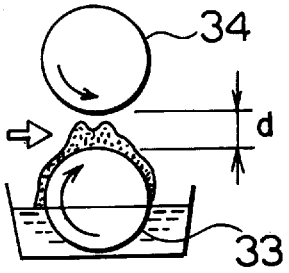
Figure 12:
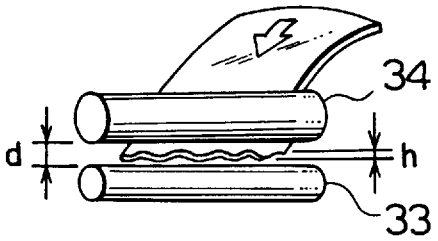
Figure 13:
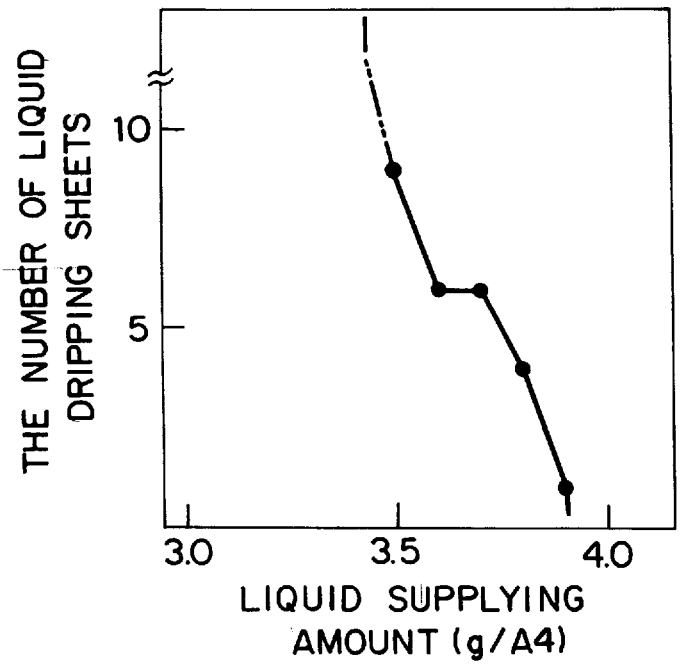
Figure 14:
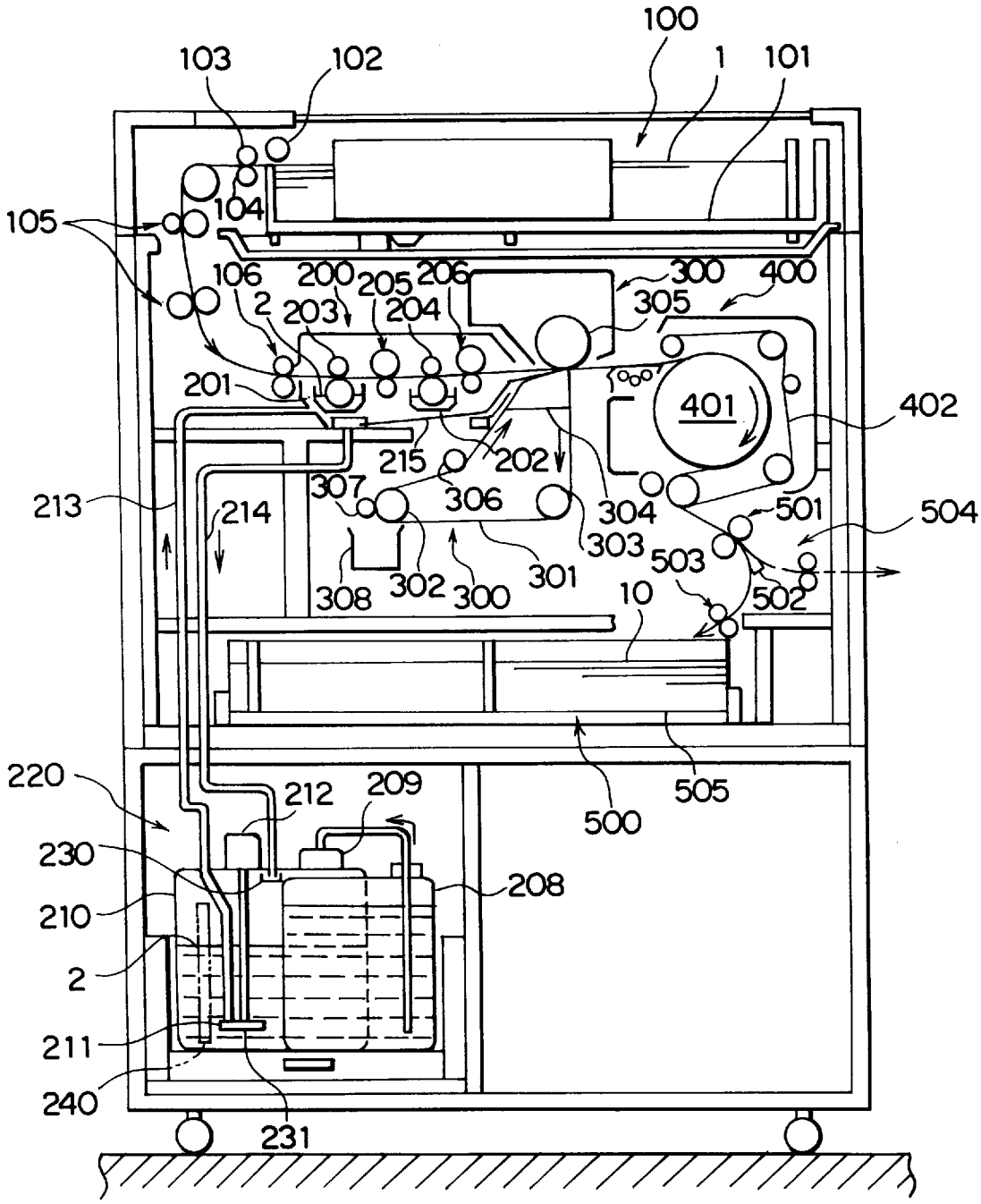
Figure 15A:
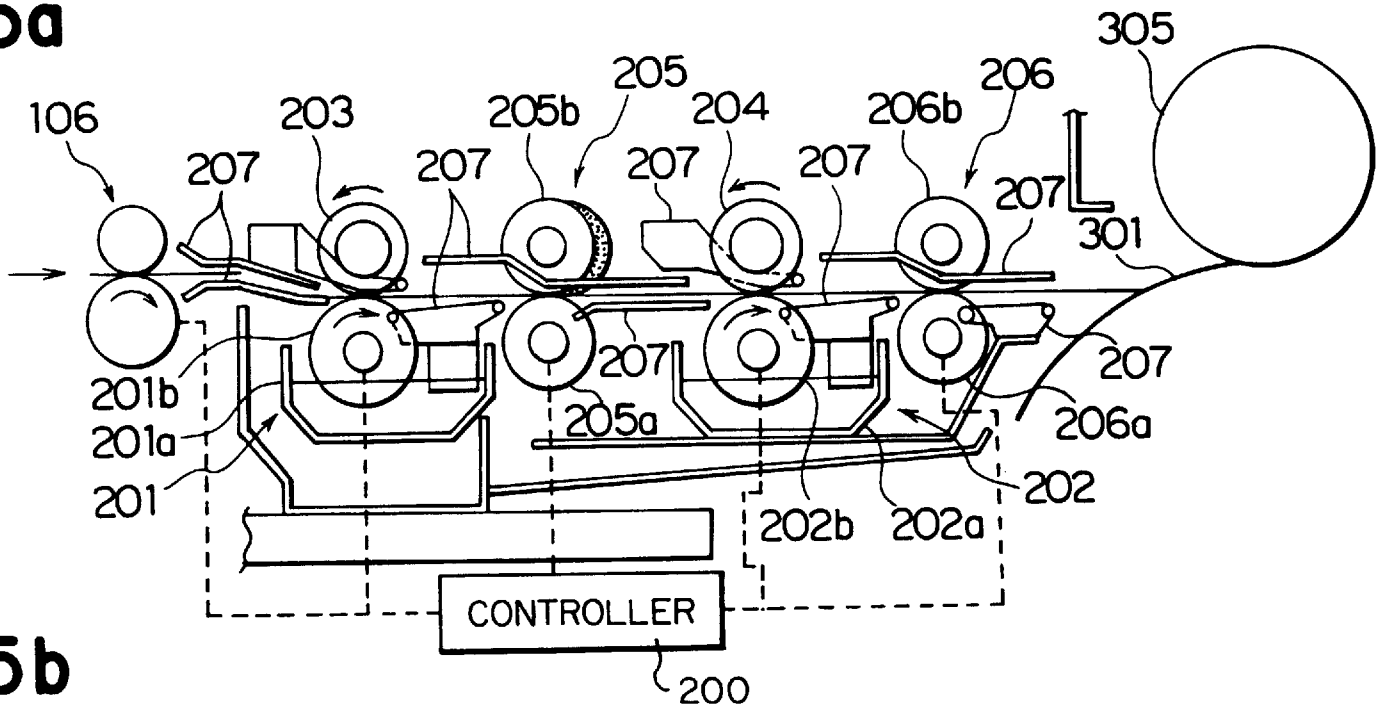
Figure 15B:
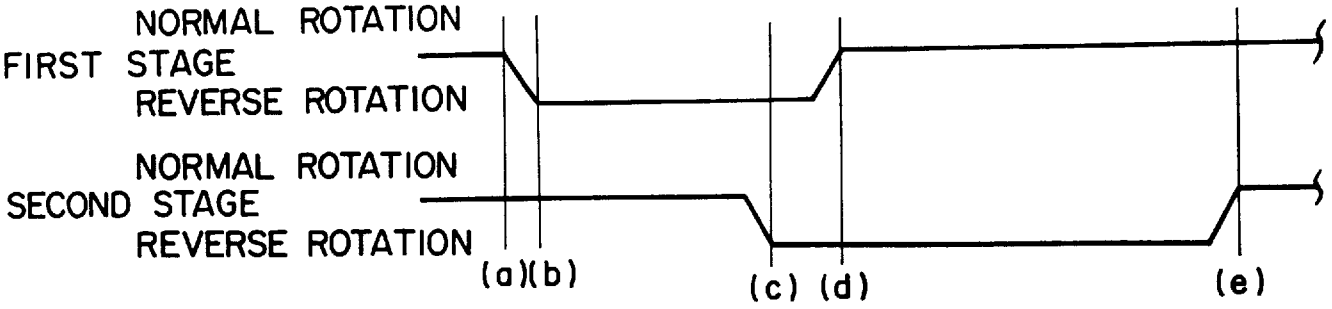

each of FIGS. 3*a* to 3*c* is a view for explaining a main portion of the toner removing apparatus in accordance with one embodiment of the present invention;

FIG. 4 is a graph showing the relation between the number of rotations of a liquid coating roller and a liquid impregnating amount of a transfer paper sheet;

FIG. 5 is a view for explaining liquid coating timing of each of coating devices;

FIG. 6 is a graph showing the relation between an amount of liquid coated at one time and a wavy height of the transfer paper sheet when the number of waves is equal to 5;

FIGS. 7*a* and 7*b* are views for explaining problems to be solved by the present invention;

FIG. 8 is a view for explaining wavy deformation in a boundary portion between a portion of the transfer paper sheet extending by liquid absorption and an unabsorbing portion of the transfer paper sheet into which no liquid is absorbed;

FIG. 9 is a graph showing the relation between a liquid supplying amount in two-stage liquid supply and an amount of the wavy deformation;

FIG. 10 is a graph showing the relation between a liquid supplying amount at a first stage in the two-stage liquid supply, existence or nonexistence of a paper curl, and an amount of the wavy deformation;

FIGS. 11*a* and 11*b* are views for explaining the relation between a roller gap and cutting of a liquid film on a coating roller;

FIG. 12 is a view for explaining the relation between a roller gap and a height of wavy deformation;

FIG. 13 is a graph showing the relation between a liquid supplying amount and liquid dripping in a toner separating unit;

FIG. 14 is a view showing the entire schematic construction of a toner removing apparatus in accordance with another embodiment of the present invention;

FIG. 15*a* is an enlarged view of a liquid providing unit of the toner removing apparatus shown in FIG. 14;

FIG. 15*b* is a timing chart of control of a coating roller arranged in the liquid providing unit shown in FIG. 15*a;* each of FIGS. 16*a* to 16*e* is a view for explaining a conveying position of a transfer paper sheet and a rotating state of each of rollers in timings (a) to (e) shown in FIG. 15*b;*

Figure 17A:
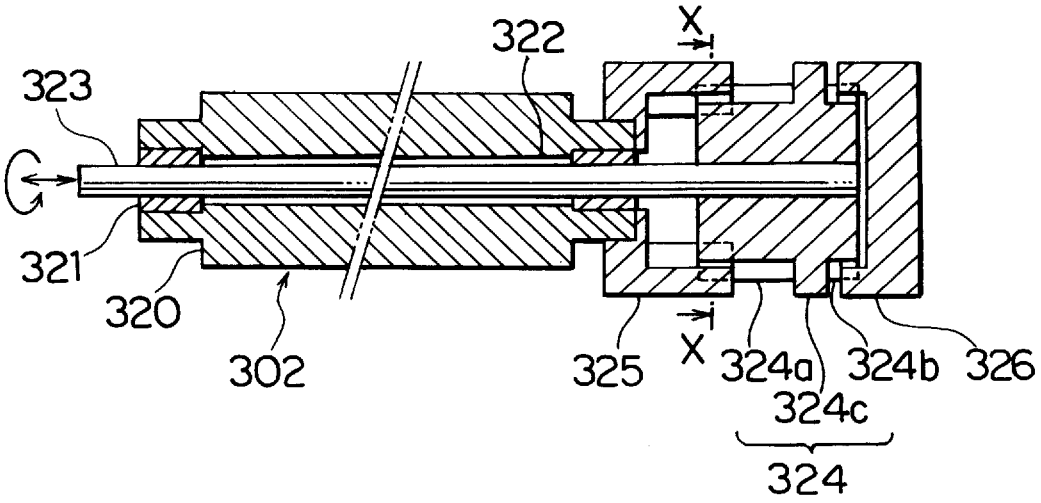
Figure 17B:
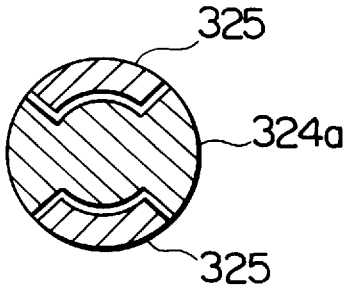

FIG. 17*a* is a view showing the schematic construction of a drive roller device in accordance with another embodiment of the present invention;

FIG. 17*b* is a cross-sectional view taken along line X—X in FIG. 17*a*; and each of FIGS. 18*a* to 18*d* is a view for explaining a modified example of a toner separating unit in the toner removing apparatus shown in FIG. 14.

DESCRIPTION OF THE PREFERRED EMBODIMENTS

The preferred embodiments of a method and an apparatus for removing an image forming substance from an image holding member in the present invention will next be described in detail with reference to the accompanying drawings.

In the following description, the present invention is applied to an image forming substance removing apparatus (called a toner removing apparatus) as an embodiment. In this toner removing apparatus, hydrophobic and thermally flexible toner for electrophotography as an image forming substance is removed from a sheet of transfer paper as an image holding member on which an image is formed by an electrophotographic copying machine.

One example of the toner removing apparatus applying the present invention thereto will first be explained schematically.

Figure 2:
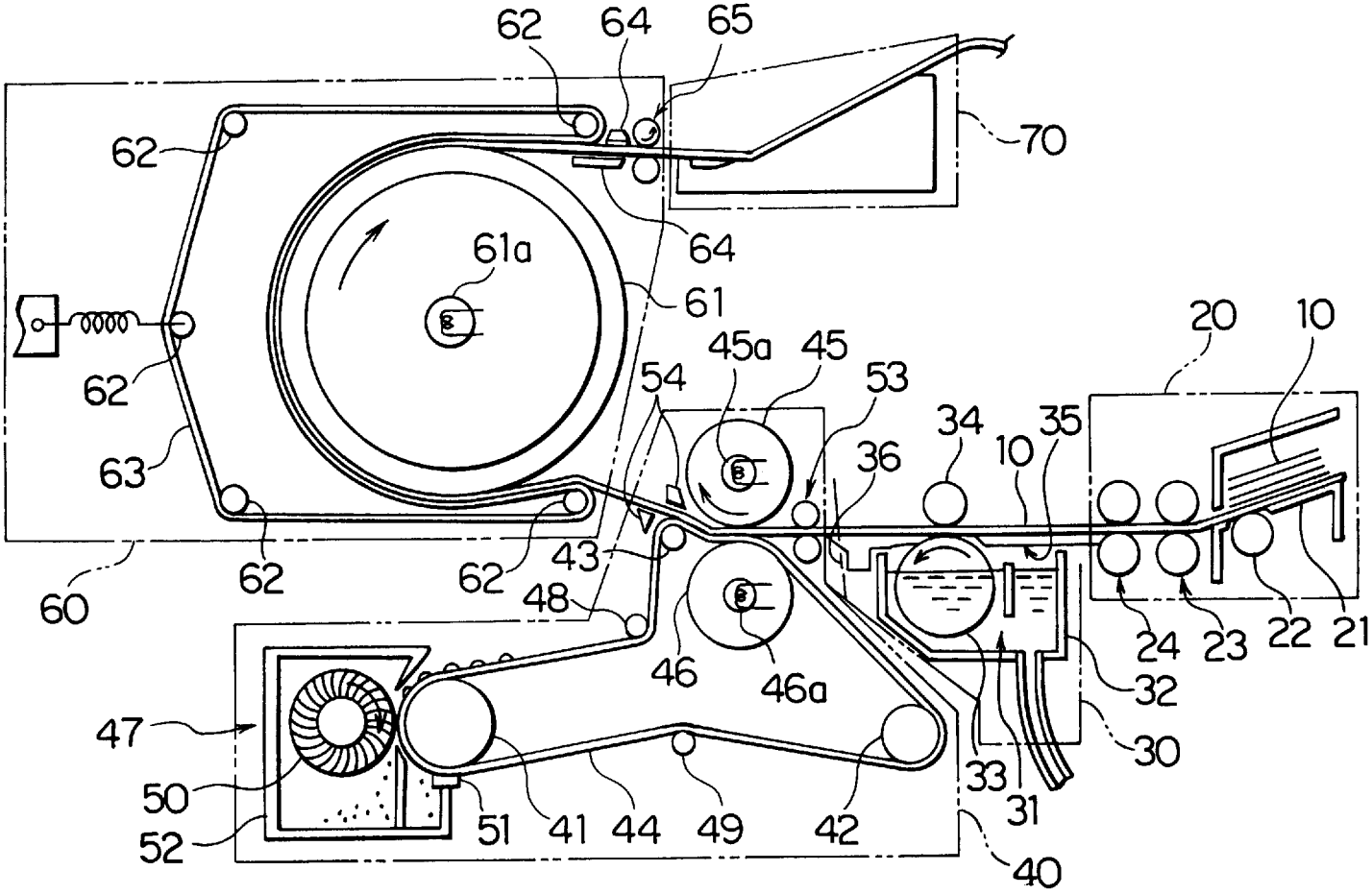
FIG. 2 is a view showing the schematic construction of a toner removing apparatus to which the present invention can be applied.

In FIG. 2, this toner removing apparatus has a paper feed unit 20 for separating and feeding transfer paper sheets 10 having toner images and stored in a stacking state one by one. The toner removing apparatus also has a liquid supplying unit 30 for supplying a liquid to a transfer paper sheet 10 fed from the paper feed unit 20. The toner removing apparatus also has a toner separating unit 40 as a separating means for separating toner from the transfer paper sheet 10 having the supplied liquid. The toner removing apparatus also has a drying unit 60 for drying the transfer paper sheet 10 from which the toner is removed. The toner removing apparatus further has a paper receiving unit 70 for receiving the transfer paper sheet 10 discharged from the drying unit 60.

The paper feed unit 20 feeds transfer paper sheets 10 stacked on a paper feed base 21 from a lowermost sheet by a paper feed roller 22 in a state in which a sheet face forming a toner image thereon is directed downward. In the following description, this sheet face is called a toner image face. Overlapped paper sheets are separated from each other by a separating roller pair 23 so that only one transfer paper sheet 10 is fed out by a paper feed conveying roller pair 24. Concrete construction and operation of the paper feed unit 20 are similar to those in a paper feed mechanism in an electrophotographic copying machine. Accordingly, a detailed explanation of the paper feed unit 20 is omitted in the following description.

The liquid supplying unit 30 supplies water or a liquid 31 such as an aqueous solution including a surfactant to the transfer paper sheet 10 so as to improve permeability with respect to the transfer paper sheet 10. In the example shown in FIG. 2, the liquid supplying unit 30 has a liquid container 32 for storing this liquid. The liquid supplying unit 30 also has a coating roller 33 arranged such that the coating roller 33 is partially dipped in the liquid within this liquid container 32. The coating roller 33 draws up this liquid by rotation and supplies this liquid to the toner image face of the transfer paper sheet 10. The liquid supplying unit 30 further has a restricting roller 34 as a paper restricting member arranged such that the restricting roller 34 is opposed to the coating roller 33 through a paper conveying path. This coating roller 33 can be constructed by using a material having a liquid holding property such as a hydrophilic porous material, a sponge, etc., an elastic member of rubber or a rigid body of a metal, etc.

This liquid supplying unit 30 also has a first paper guide mechanism 35 for guiding the transfer paper sheet 10 fed from the paper feed unit 20 to an opposite portion of the coating roller 33 and the restricting roller 34. This opposite portion is called a liquid supplying portion in the following description. The liquid supplying unit 30 further has a second paper guide mechanism 36 for guiding the transfer paper sheet 10 passing through the liquid supplying portion onto the side of a toner separating unit 40.

As shown in FIG. 2, it is necessary to provide a required amount of the liquid to the transfer paper sheet 10 at one time when the liquid is supplied by using only one coating roller 33. Accordingly, there is a fear of causing wavy deformation as mentioned above. To reduce such wavy deformation, the required liquid amount is divided into plural amounts and is provided to the transfer paper sheet 10 in the embodiment of the present invention. A concrete example of the liquid supplying unit 30 will be described in detail later.

The toner separating unit 40 has a belt 44 for a toner offset as a separating belt wound around plural belt supporting rollers 41, 42 and 43. This belt 44 is called an offset belt in the following description. The toner separating unit 40 also has upper and lower heating rollers 45 and 46 arranged such that these heating rollers come in press contact with each other through the offset belt 44. Heating lamps 45*a* and 46*a* are respectively arranged within the upper and lower heating rollers 45 and 46. The toner separating unit 40 further has a belt cleaner 47 for removing toner from a surface of the offset belt 44. At least a surface of this offset belt 44 is formed by a material set such that adhesive force between softened toner and this offset belt surface is stronger than that between the softened toner and a surface of the transfer paper sheet 10. For example, the offset belt itself is formed by a metallic material including aluminum, copper, nickel, etc., or a high-molecular material such as polyethylene terephthalate (PET) in which a titanium oxide is diffused.

This offset belt 44 is supported by the supporting rollers 41, 42 and 43. Moving directions of the offset belt 44 are suddenly changed around the supporting roller 43 around which a portion of the offset belt 44 is wound after this offset belt portion passes through a pressurizing portion of the upper and lower heating rollers 45 and 46. Thus, the transfer paper sheet 10 is separated from the offset belt 44 by curvature. The supporting roller 43 is called a separating roller in the following description. A guide roller 48 pushes a portion of the offset belt 44 inward between the separating roller 43 and the supporting roller 41 opposite to a belt cleaning unit. This guide roller 48 is arranged to increase a change in moving direction of the offset belt 44. A tension roller 49 is also arranged to push a portion of the offset belt 44 inward between the supporting roller 42 and the supporting roller 41 opposite to the belt cleaning unit.

The upper and lower heating rollers 45 and 46 are used to make the toner image face of the transfer paper sheet 10 come in close contact with the offset belt 44 and heat and soften toner fixed to the transfer paper sheet 10.

The belt cleaner 47 has a rotating brush roller 50 for removing the attached toner from a circumferential face of the offset belt 44 by applying an intermittent scraping force to this circumferential force. The belt cleaner 47 also has a pad 51 coming in contact with the circumferential face of the offset belt 44 on a downstream side from the rotating brush roller 50 in a belt moving direction. The pad 51 removes the attached toner from the offset belt 44 by scrubbing using frictional force. Thus, the toner removed from the circumferential face of the offset belt 44 is stored into a unit casing 52.

This toner separating unit 40 has a relay conveying roller pair 53 as a supporting-conveying means for conveying the transfer paper sheet 10 fed from the liquid supplying unit 30 into a paper pressurizing portion. The toner separating unit 40 also has upper and lower guide members 54 for guiding the transfer paper sheet 10 passing through the paper pressurizing portion and separated from the offset belt 44 by curvature in a separating roller portion such that this transfer paper sheet 10 is fed to the drying unit 60.

For example, the drying unit 60 dries the transfer paper sheet 10 such that a liquid holding amount of the transfer paper sheet 10 is equal to or smaller than 10% of a paper weight. The drying unit 60 is constructed by a heating drum 61 and a belt 63 for pressing the transfer paper sheet. For example, the heating drum 61 is made of aluminum and a heating lamp 61*a* is arranged within the heating drum 61. The paper pressing belt 63 is wound around plural supporting rollers 62 and is endlessly moved in a state in which the paper pressing belt 63 is wound around a circumferential face of the heating drum 61 at a constant angle. In the example shown in FIG. 2, one supporting roller 62 also functions as a tension roller. The paper pressing belt 63 can be constructed by using a material having a heat resisting property and a gas-permeable property such as a cloth of canvas texture, cotton texture, tetronic texture, etc.

The drying unit 60 also has upper and lower guide members 64 for guiding the transfer paper sheet 10 passing through a paper supporting region formed by the heating drum 61 and the paper pressing belt 63. The drying unit 60 further has a paper discharging roller pair 65 for discharging the transfer paper sheet 10 guided by the upper and lower guide members 64 onto a paper receiving face of the paper receiving unit 70.

In the above construction, a liquid is uniformly supplied by the liquid supplying unit 30 to a toner image face of a transfer paper sheet 10 fed from the paper feed unit 20. This transfer paper sheet 10 is fed to the toner separating unit 40. In this toner separating unit 40, toner fixed onto the transfer paper sheet 10 is softened by heat from the heating rollers 45 and 46 and is attached onto a surface of the offset belt 44. When the toner is then separated from the transfer paper sheet 10 and the offset belt 44 around the separating roller 43, the toner attached onto the surface of the offset belt 44 is separated from the transfer paper sheet 10. Thus, the toner is removed from the transfer paper sheet 10. The transfer paper sheet 10 removing the toner therefrom is dried by the drying unit 61 and is discharged to the paper receiving unit 70.

In accordance with the above construction, the liquid is supplied to the transfer paper sheet 10 attaching toner thereto and the toner is separated from the transfer paper sheet 10 in a state in which the liquid destabilizes the adhesive force of the toner on the paper sheet by permeating an interfacial portion between the transfer paper sheet 10 and the toner. Accordingly, the toner can be removed from the transfer paper sheet 10 without damaging paper fibers.

Constructional examples of the liquid supplying unit capable of reducing wavy deformation of the transfer paper sheet 10 in accordance with an embodiment of the present invention will next be explained with reference to FIGS. 3*a* to 3*c*.

In FIG. 3*a*, for example, the liquid supplying unit 30 is constructed by three coating devices arranged on a conveying path of the transfer paper sheet. Each of the three coating devices is constructed by a coating roller 33, a restricting roller 34 and a liquid container 32 for storing a liquid. It is sufficient to attain a state in which the transfer paper sheet 10 absorbs a required amount of the liquid when the transfer paper sheet 10 passes through these three coating devices. Accordingly, for example, a coating amount of the liquid provided to the transfer paper sheet 10 in each of the coating devices can be set to be smaller than that of the liquid provided by the coating roller 33 of the supplying unit 30 shown in FIG. 2. Concretely, for example, as shown in FIG. 4, there is approximately a proportional relation between the number of rotations of the coating roller 33 per unit time and an amount of a developing liquid coated by the coating roller 33 and absorbed into the transfer paper sheet 10. Accordingly, the number of rotations of the coating roller 33 per unit time in each of the coating devices in this example is set to be smaller than that of the coating roller 33 of the supplying unit 30 shown in FIG. 2. In the example shown in each of FIGS. 3*a* to 3*c*, the toner separating unit 4 is constructed by using a separating roller 56 having surface characteristics similar to those of the above offset belt 44.

In FIG. 3*b*, for example, the liquid supplying unit 30 is constructed by three sets of conveying roller pairs 37, 37, 37 and upper and lower paper guide plates 38 arranged above and below conveying path portions of the transfer paper sheet between adjacent conveying roller pairs. The liquid supplying unit 30 is also constructed by two liquid storing portions 38*a* communicated with spaces which are approximately surrounded airtightly by the upper and lower paper guide plates 38 and two sets of conveying roller pairs 37, 37 through holes formed in ones of the upper and lower paper guide plates 38 such as the lower paper guide plates 38. The liquid supplying unit 30 is further constructed by a supersonic wave oscillating member 39 as a mist generator for changing a liquid stored into each of the liquid storing portions 38*a* to a mist. In this example, a desirable amount of mist can be generated by oscillational setting of the supersonic wave oscillating member 39. The desirable amount of mist liquid can be provided to the transfer paper sheet 10 during conveyance through the holes formed in the lower paper guide plates 38. In the example shown in FIG. 3*b*, the desirable amount of mist liquid is divisionally provided to the transfer paper sheet 10 at two stages.

FIG. 3*c* shows a modified example of provision of the mist liquid shown in FIG. 3*b*. In this example, holes are formed in both the upper and lower guide plates 38, 38 such that these holes are respectively communicated with liquid storing portions 38*a* and 38*b* each storing a liquid and a supersonic wave oscillating member 39. A mist liquid is provided to both upper and lower face sides of the transfer paper sheet 10 during conveyance. In this example, the mist liquid is provided onto both the sides of the transfer paper sheet 10 so that curl of the transfer paper sheet caused by a difference in extension between the front and rear faces of the transfer paper sheet 10 can be reduced in comparison with a case in which the mist liquid is provided onto only one side of the transfer paper sheet.

When the mist generator is used as in the examples of FIGS. 3*b* and 3*c* and is operated at all times, the liquid is uselessly consumed. Accordingly, it is desirable to operate the mist generator only when mist generation is truly required. Therefore, for example, the mist generator is started by controller 100 after a front end of the transfer paper sheet 10 is detected by a paper sensor 10*a* arranged on an upstream side in a conveying direction of the transfer paper sheet from a mist generating region as shown in FIG. 3*c*. The operation of the mist generator is stopped when a rear end of the transfer paper sheet 10 is detected by a paper sensor 10*b* arranged on a downstream side in the conveying direction of the transfer paper sheet from the mist generating region as shown in FIG. 3*c*. Otherwise, the operation of the mist generator may be started by using a required time from a start of the paper feed by the paper feed unit 20 of FIG. 2 until the front end of the transfer paper sheet reaches a position corresponding to the paper sensor 10*a*. In this case, this required time is stored in advance and the operation of the mist generator is started when the required time has passed by measuring a time passing from the paper feed using a timer. A similar timer may be also used with respect to the stoppage of the operation of the mist generator. In this case, a size of the transfer paper sheet 10 is detected by a well-known size detecting method and information of this size is also used to stop the operation of the mist generator. The above starting and stopping controls of the operation of the mist generator may be applied to starting and stopping controls of rotation of the coating roller 32 shown in FIG. 3*a*.

As shown in FIG. 5, for example, when n (plural) coating devices each constructed by a coating roller 33, a restricting roller 34 and a liquid container 32 are used, the coating roller 33 in each of the coating devices is started when a front end portion of the transfer paper sheet 10 reaches an opposite portion between this coating roller 33 and the restricting roller 34. In each of the coating devices, the transfer paper sheet 10 is coated with a constant amount of liquid provided to such an extent that no transfer paper sheet 10 is deformed in a wavy shape. Thus, a predetermined amount of liquid is included in the transfer paper sheet 10 passing through all the coating devices.

It becomes clear from an experiment of the inventors of this patent application that there is a relation as shown in FIG. 6 between a coating liquid amount provided to the transfer paper sheet 10 at one time and a wavy height of the transfer paper sheet 10. In this relation, the wavy height of the transfer paper sheet 10 is increased as the coating liquid amount provided to the transfer paper sheet 10 at one time is increased. In this experiment, a sheet of transfer paper of size A4 is used as the transfer paper sheet 10 and the transfer paper sheet 10 has five wavy portions.

Therefore, plural coating devices are arranged as shown in FIGS. 3*a* to 3*c* or FIG. 5. A required amount of liquid in a toner removing process of the transfer paper sheet 10 is divided into plural amounts and is provided to the transfer paper sheet 10. Thus, the liquid amount provided to the transfer paper sheet 10 at one time is reduced so that wavy deformation and wrinkles of the transfer paper sheet 10 can be reduced in comparison with a case in which the liquid amount is provided to the transfer paper sheet 10 at one time.

However, the following contents also become clear from the experiment of the inventors of this patent application. Namely, when an aqueous solution including at least a surfactant is used as the above liquid, the aqueous solution is easily absorbed into the transfer paper sheet 10 by an action of the surfactant as concentration of the surfactant in the aqueous solution is increased. Therefore, there is a case in which no wavy deformation of the transfer paper sheet 10 can be effectively restrained by simply reducing the liquid amount provided to the transfer paper sheet 10 at one time. Namely, when the transfer paper sheet 10 is coated with an aqueous solution having a high concentration of the surfactant in a first coating device, this aqueous solution is absorbed into the transfer paper sheet 10 for a short time and a liquid absorbing portion of the transfer paper sheet 10 tends to suddenly extend. Therefore, the transfer paper sheet 10 is deformed in a wavy shape in a boundary portion between the liquid absorbing portion and a liquid unabsorbing portion of the transfer paper sheet.

Accordingly, when an aqueous solution including at least a surfactant is used as the above liquid, it is necessary to restrain the liquid coating amount provided to the transfer paper sheet at one time so as to restrain the above boundary portion of the transfer paper sheet from deformed in a wavy shape. Further, it is necessary to reduce a liquid absorbing speed of the transfer paper sheet 10 so as to restrain the liquid absorbing portion of the transfer paper sheet from suddenly extend.

Therefore, in this embodiment, when an aqueous solution including at least a surfactant is used as the above liquid, the liquid amount is divided into plural amounts as shown in FIGS. 3*a* to 3*c* or FIG. 5 and the transfer paper sheet is coated with this divisional liquid. Further, the transfer paper sheet is first coated with a liquid having a relatively low concentration of the surfactant and is gradually coated with a liquid having a higher concentration of the surfactant. Thus, the transfer paper sheet 10 is first coated with the liquid having a low concentration of the surfactant. Therefore, no liquid is absorbed into the transfer paper sheet 10 for a short time so that sudden extension of a liquid absorbing portion of the transfer paper sheet can be prevented. Accordingly, it is possible to prevent the transfer paper sheet from being deformed in a wavy shape in a boundary portion between the liquid absorbing portion and a liquid unabsorbing portion of the transfer paper sheet.

The following contents are found from the experiment of the inventors of this patent application. Namely, when the transfer paper sheet 10 absorbs a predetermined amount of liquid and extends to its full length, no transfer paper sheet extends any more even when the transfer paper sheet is then coated with a liquid having any concentration of the surfactant or is coated with a liquid having any amount. Accordingly, no transfer paper sheet is almost deformed in a wavy shape.

In this embodiment, when the transfer paper sheet unextending to its full length is coated with a liquid, the transfer paper sheet may be gradually coated with a liquid having a high concentration of the surfactant. When the transfer paper sheet 10 extending to its full length is coated with a liquid, the transfer paper sheet is coated with a liquid having a predetermined concentration of the surfactant.

When the above coating method is used and no liquid absorbing time of the transfer paper sheet 10 is considered, the transfer paper sheet 10 extending to its full length is not necessarily coated with the liquid having a high surfactant concentration, but may be coated with a liquid having a low surfactant concentration.

The transfer paper sheet 10 extending to its full length may be coated with a relatively large amount of liquid at one time.

In the above experiment of the inventors, for example, 4 g (grams) of an aqueous solution of 1 wt % in surfactant concentration is provided at one time to the transfer paper sheet 10 of size A4 and 4 g in liquid amount required for a toner removing process. In this case, wrinkles are caused in the transfer paper sheet 10 after the toner removing processing is completed.

Therefore, the surfactant concentration is set to 0.2 wt % to prevent the transfer paper sheet 10 from suddenly extending by the above high surfactant concentration. Further, 4 g of the liquid is divided into two liquid amounts and is coated (namely, a coating operation of 2 g of the liquid is performed twice) to prevent the transfer paper sheet 10 from being deformed in a wavy shape by a large amount of the liquid provided to this paper sheet at one time and satisfy a required liquid amount for the toner removing process. In this case, it is possible to prevent the transfer paper sheet 10 from being deformed with wrinkles after the toner removing processing is completed.

In accordance with each of the above constructional examples, a required amount of the liquid for the toner removing process of the transfer paper sheet 10 is divided into plural amounts and is provided to the transfer paper sheet 10. Accordingly, wavy deformation and wrinkles of the transfer paper sheet 10 can be reduced in comparison with a case in which the liquid is provided to the transfer paper sheet 10 at one time.

In the above embodiment, the present invention is applied to the toner removing apparatus for removing toner as an image forming substance from the normal transfer paper sheet 10. However, the present invention is not limited to this toner removing apparatus. For example, the present invention can be also applied to a device for removing the image forming substance from an image holding member constructed by a laminated material, etc. in which a surface layer of a base sheet such as a plastic layer is formed by a material layer such as paper having a liquid absorbing property and an elastic property.

An embodiment of the liquid supplying unit of the toner removing apparatus of FIG. 2 will next be explained. In this embodiment, the liquid supplying unit has a roller pair composed of a coating roller 33 and a restricting roller 34 as shown in FIG. 3*a* at two stages.

FIG. 9 shows searching results of a wavy deforming degree (waving degree) of the transfer paper sheet 10 by using a two-stage coating device when the transfer paper sheet is conveyed in a fibrous direction and is coated with a liquid while a coating amount provided by each of coating rollers 33 is changed. The two-stage coating device is constructed by the two coating rollers 33 arranged such that each of the coating rollers 33 is partially dipped into a liquid container 32. The two-stage coating device is also constructed by restricting rollers 34 arranged such that the restricting rollers 34 are opposed to top portions of the respective coating rollers 33. Concretely, about 1 g of liquid (a supplied liquid amount per paper size A4) is supplied to the transfer paper sheet at point A by a coating roller at a first stage. This liquid amount is similarly supplied to the transfer paper sheet in the following description. Thereafter, about 3.5 g of liquid is supplied to the transfer paper sheet at point B by a coating roller at a second stage. Accordingly, about 4.5 g of liquid as a total is supplied to the transfer paper sheet. In another case, about 3.5 g of liquid is supplied to the transfer paper sheet at point C by the coating roller at the first stage. Thereafter, about 1.0 g of liquid is supplied to the transfer paper sheet at point D by the coating roller at the second stage. Accordingly, about 4.5 g of liquid as a total is supplied to the transfer paper sheet in this case. Further, for comparison, FIG. 9 also shows searching results of a case in which about 4.5 g of liquid is supplied to the transfer paper sheet at point E by only the coating roller at the first stage.

The following contents can be known from FIG. 9. Namely, as mentioned above, when about 4.5 g of liquid is divided into plural times (two times in this example) and is supplied to the transfer paper sheet (at point B or D) so as to set a liquid supplying state of the transfer paper sheet by this liquid amount, wavy deformation of the transfer paper sheet can be restrained in comparison with a case in which about 4.5 g of liquid is supplied to the transfer paper sheet by one coating at point E. Further, when the transfer paper sheet is divisionally coated with the liquid plural times such as two times, wavy deforming amounts of the transfer paper sheet coated by the second stage roller pair are different from each other in accordance with a concrete liquid divisional method in which a final liquid supplying amount is divided into coating amounts of the first stage roller pair and the second stage roller pair.

In accordance with the research of the inventors of this patent application, when a predetermined amount of liquid is divided into two amounts and is supplied to the transfer paper sheet by using the coating rollers as mentioned above and a first coating amount is set to be excessively small, the transfer paper sheet is curled when the transfer paper sheet is conveyed in a direction perpendicular to its fibrous direction. In the following description, the conveyance in this perpendicular direction is called Y-directional conveyance. It is difficult to preferably convey the transfer paper sheet by an error in movement of the transfer paper sheet between roller pairs at the second stage, etc. in a state in which the transfer paper sheet is curled.

Accordingly, it is desirable to reduce a coating amount at the first stage as much as possible so as to prevent the transfer paper sheet from being curled in the Y-directional conveyance in view of a conveying property of the transfer paper sheet.

However, this requirement is opposed to a requirement in which the first coating amount is reduced as much as possible to restrain the wavy deformation of the transfer paper sheet caused in the liquid supply when the transfer paper sheet is conveyed in its fibrous direction as mentioned above. This conveyance in the fibrous direction is called T-directional conveyance in the following description. For example, FIG. 10 shows searching results of the relation of a liquid supplying amount, existence or non-existence of curl, a wavy deforming amount (waving degree) immediately after the transfer paper sheet passes through the first stage roller pair while a liquid supplying amount provided by the first stage roller pair is changed by changing rotating speeds of coating rollers in the first stage roller pair.

In accordance with the research of the inventors of this patent application, it becomes clear that the wavy deformation of the transfer paper sheet caused by the liquid supply of the first stage roller pair is slightly reduced with the passage of time after the transfer paper sheet passes through the first stage rollers and a liquid is supplied to the transfer paper sheet by the second stage roller pair. Accordingly, with respect to the first stage roller pair, it is desirable to set the liquid supplying amount by preferentially preventing the above curl causing an error in conveyance in comparison with prevention of the wavy deformation of the transfer paper sheet. For example, in the example of FIG. 10, it is desirable to set the liquid supplying amount of the first stage roller pair to about 2.0 g so as to almost prevent the curl of the transfer paper sheet and reduce the wavy deformation as much as possible. In general, for example, it is desirable to approximately supply a liquid amount from 1.9 to 2.2 g per paper size A4 to the transfer paper sheet.

Further, in accordance with the research of the inventors of this patent application, it becomes clear that a distance (called a roller gap in the following description) between each of the above coating rollers and each of the above restricting rollers is desirably set to such an extent that no restricting force is applied to the transfer paper sheet conveyed by a conveying means. In accordance with setting of such a roller gap, it is possible to restrain the wavy deformation of the transfer paper sheet caused in the liquid supply using the first stage roller pair when the transfer paper sheet is conveyed in its fibrous direction (in the T-directional conveyance). This is probably because it is difficult to prevent the transfer paper sheet from extending by liquid absorption in a direction perpendicular to paper fibers. Further, wrinkles of the transfer paper sheet can be restrained by the second stage roller pair. This is probably because no wavy deformation of the transfer paper sheet caused in the liquid supply using the first stage roller pair is fixed by the second stage roller pair. This is different from a case in which the transfer paper sheet is supported by the second stage roller pair in a thickness direction thereof. It is desirable to increase the above roller gap so as to reduce the wavy deformation of the transfer paper sheet and the wrinkles of the transfer paper sheet caused by fixing this wavy deformation. For example, FIG. 11*a* shows a case of a roller gap d in which a preferable liquid coating operation can be performed. Different from this case, when the roller gap d is excessively increased as shown in FIG. 11*b*, a liquid film is partially cut on a coating roller so that no transfer paper sheet is uniformly coated with a liquid. Accordingly, there is an upper limit of the roller gap d from this view point.

With respect to the second stage roller pair, it is desirable to set a roller gap within a range from 1.5 to 3.0 times a thickness of the transfer paper sheet. When this roller gap is smaller than 1.5 times the paper thickness, the wavy deformation caused in the liquid supply using the first stage roller pair strongly tends to be fixed by the second stage roller pair. In contrast to this, when this roller gap is greater than 3.0 times the paper thickness, it is difficult to obtain a required liquid supplying amount.

For example, the distance between the first stage roller pair and the second stage roller pair is desirably set as shown in FIG. 12 such that the transfer paper sheet is fed to the second stage roller pair after a height h of the wavy deformation caused in the liquid supply using the first stage roller pair is equal to or smaller than the roller gap d with respect to the second stage roller pair. A wavy deforming height of each of portions of the transfer paper sheet is reduced with the passage of time. Accordingly, the above distance is determined in consideration of the relation of this distance and a conveying speed. In accordance with this construction, no wavy deformation is easily fixed by the second stage roller pair in comparison with a case in which the transfer paper sheet is fed between the pair of second stage rollers in a state in which the wavy deforming height provided in the liquid supply using the first stage roller pair is greater than the roller gap of the second stage roller pair. Accordingly, no wrinkles of the transfer paper sheet are correspondingly caused easily.

For example, since the distance between the first stage roller pair and the second stage roller pair is set as mentioned above, the transfer paper sheet is also unstably conveyed in the case of the T-directional conveyance as well as the case of the Y-directional conveyance in which the transfer paper sheet is easily curled by the liquid supply using the first stage roller pair when this distance is excessively increased from the relation of this distance and a length of the transfer paper sheet in its conveying direction. In this case, an auxiliary conveying member for relay is arranged between both the roller pairs. Similar to the second stage roller pair, such an auxiliary conveying member for relay is desirably constructed by using a roller pair, etc. having a roller gap equal to or higher than a wavy deforming height of the transfer paper sheet passing through the auxiliary conveying member. In accordance with such a construction, conveyance of the transfer paper sheet is stabilized. Further, similar to the second stage roller pair, it is possible to reduce a fear of fixing the wavy deformation of the transfer paper sheet caused in the liquid supply using the first stage roller pair as it is.

The rollers of the first and second stage roller pairs are desirably formed such that surfaces of these rollers have an affinity for a liquid supplied to the transfer paper sheet. For example, at least surfaces of these rollers are formed by a hydrophilic material in this embodiment in which water or an aqueous solution is used as a processing liquid. A material having preferable hydrophilicity can be preferably constructed by using many inorganic compounds such as various kinds of oxides of $TiO_2$, ZnO, $SiO_2$, $A1_2O_3$, etc. salts of $CuCO_3$, $BaSO_4$, etc. A preferable material can be obtained by performing hydrophilic processing with respect to a surface of each of such inorganic compounds. An organic compound having hydrophilicity, especially, a polymer providing hydrophilicity thereto is a preferable material. The polymer must have a hydrophilic bipolar group along a molecular chain to provide hydrophilicity for the polymer. However, when the number of poles of the hydrophilic group is excessively increased, the polymer is dissolved into water so that no polymer can be used many times. Accordingly, when the polymer is formed to be hydrophilic, a hydrophilic polar group must be provided to the polymer to such an extent that no polymer is dissolved into water. It is desirable to include an organic compound having two functional groups or more such as epoxy group, isocyanate group as a bridging agent within one molecule with respect to the hydrophilic polymer formed as mentioned above when adhesive, mechanical and durable properties of the hydrophilic polymer are improved.

When a roller having an affinity surface for a liquid is used, a uniform liquid film can be formed on this surface since a coating roller 33 has a hydrophilic surface. Accordingly, the liquid can be uniformly provided to the transfer paper sheet. In particular, it is possible to prevent generation of a liquid uncoating portion of the transfer paper sheet. A restricting roller 34 also has a hydrophilic surface in addition to the coating roller 33. Therefore, it is possible to more effectively uniform the above supplied liquid and prevent the generation of the liquid uncoating portion of the transfer paper sheet. Accordingly, it is possible to prevent wavy deformation caused by ununiformity of the supplied liquid and the generation of the liquid uncoating portion of the transfer paper sheet and prevent wrinkles of the transfer paper sheet caused by fixing the wavy deformation as it is.

There is a required lowest limit in amount of the liquid to be supplied to the transfer paper sheet by the liquid supplying unit so as to preferably separate and remove toner from the transfer paper sheet without damaging fibers of the transfer paper sheet by the above toner separating unit 40. However, in accordance with the research of the inventors of this patent application, when the above liquid amount is excessively increased, liquid dripping is caused as in the toner separating unit 40 of FIG. 2 in which the transfer paper sheet passes through a pressurizing portion by the heating rollers 45 and 46, etc. Therefore, the following problems are caused. Namely, temperatures of the heating rollers 45 and 46 are unstably adjusted and portions around the toner separating unit are polluted. Further, a temperature of the offset belt 44 is partially reduced so that no toner is sufficiently removed partially from the transfer paper sheet. Such problems can be solved to a certain extent by adjusting and setting the temperatures of the upper and lower heating rollers 45 and 46 to higher temperatures. However, in this case, power consumption of these heating rollers is increased and no transfer paper sheet is sufficiently separated from the offset belt 44. Further, the number of restrictions of the transfer paper sheet as an original capable of preferably removing toner therefrom is increased.

Therefore, a total liquid amount supplied by the liquid supplying unit is desirably set to an amount determined such that no liquid dripping is caused in the above press contact portion of the toner separating unit 40. Concretely, the total liquid amount depends on a strength of press contact force in the above press contact portion, etc. FIG. 13 shows searching results of the relation of a liquid supplying amount per paper size A4 and the number of liquid drip starting sheets when toner removing processing is continuously performed with respect to ten transfer paper sheets at an interval of 20 mm in the toner removing apparatus of FIG. 2. In the example of FIG. 13, if the liquid supplying amount per paper size A4 is smaller than about 3.5 g, no liquid dripping is caused in the above press contact portion in the continuous processing of the ten transfer paper sheets. From these results, it is considered that no liquid dripping is caused even in the continuous processing of more than ten transfer paper sheets if the liquid supplying amount per paper size A4 is smaller than about 3.5 g. Accordingly, in this example, generation of the above problems can be prevented if the liquid supplying amount per paper size A4 is set to be smaller than about 3.5 g.

It is desirable to construct the first and second stage roller pairs such that the roller gaps of these roller pairs can be independently adjusted every roller pair. In accordance with this construction, the roller gaps can be finely adjusted in accordance with a paper kind, a paper thickness, a liquid (surfactant) concentration, a conveying speed, etc. when the toner removing apparatus is assembled in a factory, etc. Accordingly, wide use (generality) of the toner removing apparatus can be improved.

In accordance with first to ninth constructions of the present invention, an amount of unstabilizing liquid according to a liquid absorbing amount of an image holding member required to preferably remove an image forming substance therefrom is divided into plural amounts and is provided to the image holding member. Therefore, wavy deformation of the image holding member is reduced in comparison with wavy deformation caused when a required amount of the unstabilizing liquid is provided to the image holding member at one time. Accordingly, after toner as the image forming substance is removed from the image holding member, the wavy deformation and wrinkles of the image holding member can be reduced in comparison with a case in which a required amount of the unstabilizing liquid is provided to the image holding member at one time.

In particular, in accordance with the third construction of the present invention, the above unstabilizing liquid providing means is arranged in an apparatus for removing the image forming substance from the image holding member in the second construction. This unstabilizing liquid providing means has plural sets of coating rollers and restricting rollers. Each of the coating rollers forms a liquid film constructed by the above unstabilizing liquid on its surface and provides this liquid film to the image holding member. Each of the restricting rollers is opposed to each of the coating rollers through the image holding member and restricts a movement of the image holding member in a thickness direction thereof. In accordance with this third construction, a desirable amount of the liquid provided to the image holding member can be set by setting the number of coating rollers.

In accordance with a fourth construction of the present invention, the above unstabilizing liquid providing means is arranged in an apparatus for removing the image forming substance from the image holding member in the second construction. This unstabilizing liquid providing means is constructed by using a supersonic wave oscillator for changing the unstabilizing liquid to a mist and providing this unstabilizing mist liquid to the image holding member. Accordingly, a small amount of the liquid can be provided to the image holding member and the liquid can be relatively uniformly provided to the image holding member.

In accordance with a fifth construction of the present invention, oscillation of the supersonic wave oscillator is started in the image forming substance removing apparatus having the fourth construction when the image holding member approaches a mist generating portion of the supersonic wave oscillator. Accordingly, a useless consuming amount of the unstabilizing liquid can be reduced in comparison with a case in which the supersonic wave oscillator is operated at any time.

In accordance with a sixth construction of the present invention, the unstabilizing liquid is provided to the image holding member from both front and rear face sides thereof. Accordingly, curl of the image holding member caused by a difference in extension between the front and rear face sides of the image holding member can be reduced in comparison with a case in which the unstabilizing liquid is provided to the image holding member from one face side thereof.

In accordance with a seventh construction of the present invention, an amount of the unstabilizing liquid provided to the image holding member at one time by the unstabilizing liquid providing means is set to an amount determined to such an extent that no wavy deformation is caused in the image holding member. Generation of the wavy deformation can be restricted even when the unstabilizing liquid is provided to the image holding member including no liquid.

In accordance with an eighth construction of the present invention, an aqueous solution including at least a surfactant is used as the unstabilizing liquid. Surfactant concentrations of the unstabilizing liquid provided by the unstabilizing liquid providing means are set to be different from each other at respective providing times of the unstabilizing liquid. When a liquid having a high surfactant concentration is first provided to the image holding member, the liquid is absorbed into the image holding member for a short time. However, in the present invention, for example, if a liquid having a high surfactant concentration is gradually provided to the image holding member, wavy deformation can be restricted in a boundary portion between a liquid unabsorbing portion and a liquid absorbing portion of the image holding member suddenly extending.

In accordance with a ninth construction of the present invention, the coating rollers and the restricting rollers are arranged such that the coating and restricting rollers are opposed to each other at predetermined intervals. Therefore, a transfer paper sheet as the image holding member can freely extend by the liquid supply in comparison with a case in which both the coating and restricting rollers come in contact or press contact with each other. Accordingly, it is possible to reduce wavy deformation of the transfer paper sheet by preventing its extension by the liquid supply between the coating and restricting rollers.

In the ninth construction, surfaces of both the coating and restricting rollers are constructed by a material having an affinity for the unstabilizing liquid. A film of the unstabilizing liquid can be preferably formed on each of the coating rollers so that generation of irregular liquid coating caused by partial cutting of the liquid film can be reduced.

In the following description, the present invention is applied to another embodiment of a toner removing apparatus for removing thermally melted toner as an image forming substance from a sheet of transfer paper as an image holding member on which an image is formed by an electrophotographic copying machine of a transfer type.

FIG. 14 is a view showing the schematic construction of a toner removing apparatus as one constructional example to which the present invention can be applied.

An entire construction of the toner removing apparatus will first be explained. This toner removing apparatus has a paper feed unit 100 for separating transfer paper sheets 1 stored in a stacking state and having toner images thereon from each other and feeding the separated transfer paper sheets one by one. The toner removing apparatus also has a liquid providing unit 200 as an unstabilizing liquid providing means for providing an unstabilizing liquid to a transfer paper sheet 1 fed from the paper feed unit 100. The toner removing apparatus also has a liquid supplying device 220 for supplying a processing liquid 2 described later to the liquid providing unit 200. The toner removing apparatus also has a toner separating unit 300 as a separating means for separating and removing toner from the transfer paper sheet 1 having the supplied unstabilizing liquid. The toner removing apparatus also has a drying unit 400 for drying the transfer paper sheet 1 from which the toner is removed. The toner removing apparatus further has a paper receiving unit 500 for receiving the transfer paper sheet 1 discharged from the drying unit 400.

The paper feed unit 100 feeds transfer paper sheets 1 stacked on a bottom plate 101 from an uppermost sheet by a paper feed roller 102. Overlapped transfer paper sheets are separated from each other by a separating mechanism composed of a feed roller 103 and a separate roller 104 so that only one transfer paper sheet 1 is fed by the paper feed unit 100. The transfer paper sheet 1 fed from this paper feed unit 100 is conveyed by conveying roller pairs 105 and a timing adjustment and a skew correction of the transfer paper sheet 1 are made by a resist roller pair 106. Then, the transfer paper sheet 1 is fed to the next liquid providing unit 200. Concrete constructions and operations of the above paper feed unit 100, etc. are similar to those of a paper feed mechanism in an electrophotographic copying machine. Accordingly, a detailed explanation of these concrete constructions and operations is omitted in the following description.

The above liquid providing unit 200 has liquid coating devices 201 and 202 at two stages in a conveying direction of the transfer paper sheet 1. Each of the liquid coating devices 201 and 202 has a liquid container filled with a predetermined amount of the processing liquid 2 as an unstabilizing liquid for changing an attaching state of the transfer paper sheet 1 and the toner to an unstable state. Each of the liquid coating devices 201 and 202 also has a liquid coating roller arranged such that the liquid coating roller is partially dipped into a liquid within the liquid container. Paper restricting rollers 203 and 204 are respectively arranged above the liquid coating rollers of the liquid coating devices 201 and 202 such that surfaces of the liquid coating rollers and the paper restricting rollers 203 and 204 are opposed to each other at predetermined intervals. A relay roller pair 205 for conveying the transfer paper sheet is arranged between the liquid coating device 201 at a first stage and the liquid coating device 202 at a second stage in the conveying direction of the transfer paper sheet 1. A relay roller pair 206 for conveying the transfer paper sheet is arranged on a downstream side of the liquid coating device 202 at the second stage in the conveying direction of the transfer paper sheet 1. A liquid receiving tank 215 is arranged below the respective liquid coating devices 201, 202, the relay roller pairs 205, 206, etc. This liquid providing unit 200 will be described in detail later.

The above processing liquid 2 can use at least one kind of water or aqueous solution selected from a group of water, an aqueous solution including a water-soluble polymer, an aqueous solution including a surfactant, and an aqueous solution including a water-soluble polymer and a surfactant.

The above liquid supplying device 220 has an exchangeable replenishment liquid bottle 208 arranged below this device. The liquid supplying device 220 also has a processing liquid tank 210 in which the processing liquid 2 is suitably replenished from the replenishment liquid bottle 208 by an electromagnetic pump 209. The liquid supplying device 220 also has a liquid supplying pump 211 such as a blade pump, etc. build in the processing liquid tank 210. The liquid supplying device 220 also has a pump motor 212 for rotating the liquid supplying pump 211. The liquid supplying device 220 also has a liquid supplying pipe 213 for supplying the processing liquid 2 from the liquid supplying pump 211 to each of the liquid containers 201*a* and 202*a*. The processing liquid 2 is discharged to a liquid receiving tank 215 from a liquid discharging port arranged in a lower portion of each of the liquid containers 201*a* and 202*a*. The liquid supplying device 220 further has a collecting pipe 214 for returning this processing liquid 2 into the processing liquid tank 210. The processing liquid 2 supplied by the liquid supplying pump 211 is supplied to each of the liquid containers of the liquid coating devices 201 and 202 through the liquid supplying pipe 213. The processing liquid 2 received by the above liquid receiving tank 215 from the liquid containers is returned into the processing liquid tank 210 through the collecting pipe 214 so that the processing liquid is circulated. While the processing liquid 2 is steadily circulated, a liquid supplying amount provided by the liquid supplying pump 211, etc. are set such that each of the liquid coating rollers is dipped by a predetermined amount into the processing liquid 2 within each of the liquid containers in each of the liquid coating devices 201 and 202.

The above toner separating unit 300 has a belt 301 for a toner offset as a separating member having a belt shape and wound around plural supporting rollers 302 and 303, etc. This belt 301 is called an offset belt in the following description. The toner separating unit 300 also has a heating block 304 and an upper heating roller 305 arranged such that the heating block 304 and the upper heating roller 305 come in press contact with each other through the offset belt 301. A heating lamp is build in the heating block 304. The toner separating unit 300 also has a tension roller 306 for providing a predetermined tensile force to the offset belt 301. The toner separating unit 300 also has a cleaning brush 307 rotating while the cleaning brush 307 comes in contact with a surface of the offset belt 301. The cleaning brush 307 removes toner from this surface of the offset belt 301. The toner separating unit 300 further has a toner receiver 308 for receiving the toner removed by the cleaning brush 307.

The above heating block 304 and the above upper heating roller 305 are used to make a toner image face of the transfer paper sheet 1 come in close contact with the offset belt 301 and heat and soften the toner fixed to the transfer paper sheet 1.

At least a side surface of the offset belt 301 coming in contact with the toner is formed by a material having adhesive force stronger than that between a surface of the transfer paper sheet 1 and softened toner such that this adhesive force of the material can be applied to the softened toner. For example, the offset belt itself is formed by a metallic material including aluminum, copper, nickel, etc., or a high-molecular material such as polyethylene terephthalate (PET) in which a titanium oxide is diffused. The offset belt 301 may be constructed by plural layers such that at least one of these layers is set to a heat resisting layer having excellent strength and heat resisting properties and a layer coming in contact with the toner is set to an adhesive layer having an excellent adhesive property to the toner.

A bent portion is formed on a downstream side of the offset belt 301 in a moving direction thereof from a press contact portion of the heating block 304 with respect to the upper heating roller 305. This bent portion changes the moving direction of the offset belt 301 approximately 90 degrees with a predetermined curvature radius. The moving direction of the offset belt is suddenly changed around this bent portion so that the transfer paper sheet 1 is separated from the offset belt 301 by curvature.

For example, the above drying unit 400 dries the transfer paper sheet 1 such that a liquid holding amount of the transfer paper sheet 1 is equal to or smaller than 10% of a paper sheet weight. The drying unit 400 is constructed by a heating drum 401 and a belt 402 for paper pressing. For example, the heating drum 401 is made of aluminum and a heating lamp is built in this heating drum 401. The paper pressing belt 402 is wound around plural supporting rollers and is endlessly moved in a state in which the paper pressing belt 402 is wound around a circumferential face of the heating drum 401 at a constant angle. For example, the paper pressing belt 402 can be constructed by using a material having a heat-resisting property and a gas-permeable property such as a cloth of canvas texture, cotton texture, tetronic texture, etc.

The above paper receiving unit 500 is constructed by a conveying roller pair 501 for conveying the transfer paper sheet 1 from the drying unit 400, a branching claw 502, discharging roller pairs 503, 504, a built-in paper discharging tray 505, an unillustrated external paper discharging tray, etc. The transfer paper sheet can be selectively discharged to the built-in paper discharging tray 505 or the external paper discharging tray in accordance with necessity. The above built-in paper discharging tray 505 is constructed such that the built-in paper discharging tray 505 can be slidably pulled out on this side of the toner removing apparatus.

In the toner removing apparatus having the above construction, a transfer paper sheet 1 is fed from the paper feed unit 100. The processing liquid 2 is provided to a toner image face of this transfer paper sheet 1 by the liquid providing unit 200. In FIG. 14, the toner image face of the transfer paper sheet is set to a lower face thereof. This transfer paper sheet is then fed to the toner separating unit 300. For example, 2 g (grams) of the processing liquid 2 or more is provided to the transfer paper sheet 1 of size A4. In this toner separating unit 300, toner fixed to the transfer paper sheet 1 is softened by heat from the heating block 304 and the upper heating roller 305 so that the toner is attached onto a surface of the offset belt 301. When the transfer paper sheet 1 is separated from the offset belt 301 around the bent portion of the heating block 304, the toner attached onto the surface of the offset belt 301 is separated from the transfer paper sheet 1 so that the toner is removed from the transfer paper sheet 1. The transfer paper sheet 1 removing the toner therefrom is dried by the drying unit 400. The dried transfer paper sheet is then discharged by the paper discharging roller pair 503 onto the built-in paper discharging tray 505 of the paper receiving unit 500. In the above toner removing processing, the toner is separated from the transfer paper sheet in a state in which the liquid is supplied to the transfer paper sheet 1 attaching the toner thereto and permeates an interfacial portion between the transfer paper sheet 1 and the toner. Accordingly, the toner can be removed from the transfer paper sheet without damaging paper fibers.

The construction of the liquid providing unit 200 used in the above toner removing apparatus will next be explained further with reference to FIGS. 15*a* and 15*b*. In each of the liquid coating devices 201 and 202, surface intervals between the liquid coating rollers 201*b*, 202*b* and the paper restricting rollers 203, 204 are set to be slightly greater than a thickness of the transfer paper sheet such that a predetermined amount of the processing liquid can be included in the transfer paper sheet by allowing expansion of the transfer paper sheet in its thickness direction caused by permeation of the processing liquid 2. These surface intervals are desirably set to be slightly greater than the thickness of the transfer paper sheet expanded by the liquid supply. The relay roller pairs 205, 206 are respectively constructed by rubber rollers 205*a*, 206*a* on their lower sides and brush rollers 205*b*, 206*b* on their upper sides. The rubber rollers 205*a*, 206*a* and the brush rollers 205*b*, 206*b* are arranged and rotated at intervals set to such an extent that brushes of the brush rollers 205*b*, 206*b* respectively come in direct contact with surfaces of the rubber rollers 205*a*, 206*a* and are slightly flexed if no transfer paper sheet exist between the rubber and brush rollers. Thus, these relay roller pairs 205 and 206 can provide conveying force to the transfer paper sheet by supporting the transfer paper sheet between the upper and lower rollers. This supporting-conveying force is considerably weaker than that provided by the resist roller pair 106 as a supporting conveyer, and a pair of the heating block 304 and the upper heating roller 305 of the toner separating unit 300. In particular, there is a slightly wide distance between both rollers in the relay roller pair 205 at the first stage arranged between both the liquid coating devices 201 and 202. Accordingly, the above supplying-conveying force is weak in comparison with the relay roller pair 206 at the second stage. The brush roller 205*b* of the relay roller pair 205 at the first stage is constructed by a pair of brush rollers respectively supporting and brushing halves of the transfer paper sheet in a width direction thereof on a deep side and this side of the toner removing apparatus with respect to a center of the transfer paper sheet in the width direction. This pair of brush rollers are slantingly arranged such that an end portion of the transfer paper sheet on the central side thereof is located on a downstream side in the conveying direction from outside end portions of the transfer paper sheet. Accordingly, the pair of brush rollers are arranged in a V-shape seen from a side of the resist roller pair 106. Thus, the transfer paper sheet having the processing liquid supplied by the liquid coating device 201 at the first stage is conveyed while force for widening the transfer paper sheet outward in the width direction is applied to the transfer paper sheet.

Further, plural guide members 207 are arranged to guide the transfer paper sheet from the resist roller pair 106 from above and below along a conveying path between respective adjacent portions of the resist roller pair 106, the liquid coating device 201 at the first stage, the relay roller pair 205 at the first stage, the liquid coating device 202 at the second stage, the relay roller pair 206 at the second stage, and a contact portion of the upper heating roller 305 and the separating belt 301 in the toner separating unit. Each of the guide members 207 may use a thin plate arranged such that end faces of this plate are opposed to the transfer paper sheet. Each of the guide members 207 may also use a flat plate processed such that a string is pulled out. Otherwise, each of the guide members 207 may use wire. In this case, the thin plate, the flat plate or the wire is used such that a contact area between the transfer paper sheet and each of these members is reduced as much as possible. In particular, a slit portion is suitably formed in a roller surface portion with respect to a portion in which there is a fear of winding around a roller, etc. A guide member constructed by the thin plate, etc. is arranged such that this guide member is partially inserted into this slit portion. Plural guide members each constructed by the above thin plate or the wire are arranged in parallel with each other in the width direction of the transfer paper sheet.

The above resist roller pair 106 receives the transfer paper sheet 1 fed from the above-mentioned paper feed unit 100 in a stopping state and makes a skew correction of this transfer paper sheet. Thereafter, the resist roller pair 106 is rotated in the clockwise direction shown by an arrow in FIG. 15*a* in predetermined timing and is fed onto a side of the liquid coating device 201 at the first stage. This rotation of the resist roller pair 106 is continued until just before the next transfer paper sheet 1 is fed to the resist roller pair from the paper feed unit 100. The skew correction is similarly made with respect to the next transfer paper sheet 1. Thereafter, this transfer paper sheet 1 is conveyed to the side of the liquid coating device 201 at the first stage. An operation of this resist roller pair 106 is controlled such that an interval between transfer paper sheets continuously fed onto the side of the liquid coating device 201 at the first stage is constant irrespective of a size of the transfer paper sheet 1.

The rollers 201*b*, 203, 202*b*, 204 of the liquid coating devices 201, 202 at the two stages, and the rollers 205*a*, 205*b*, 206*a*, 206*b* of the relay roller pairs 205, 206 at the two stages are respectively rotated in predetermined directions such that the transfer paper sheet 1 is conveyed onto a side of the toner separating unit 300. Normal and reverse rotating directions of the two liquid coating rollers 201*b* and 202*b* can be switched. Folding of the transfer paper sheet, etc. caused by rapid traverse at a rear end of the transfer paper sheet 1 are prevented by switching the rotating directions of the two liquid coating rollers 201*b*and 202*b*. These contents will next be described in detail.

FIG. 15*b* is a timing chart of switching of the normal and reverse rotating directions of each of the liquid coating roller 201*b* at the first stage and the liquid coating roller 202*b* at the second stage. Each of FIGS. 16*a* to 16*e* is a view for explaining a conveying position of the transfer paper sheet 1 and a rotating state of each of rollers in each of timings (a) to (e) shown in FIG. 15*b*.

FIGS. 16*a* to 16*e* show an example in which the transfer paper sheet 1 of size A4 is conveyed in a short side direction thereof. Point A shows a position of a paper sensor for detecting a rear end of the transfer paper sheet and arranged on an upstream side in the conveying direction of the transfer paper sheet from the resist roller pair 106. Point B shows a nipping position of the resist roller pair 106. Point C shows a gap position between the liquid coating roller 201*b* at the first stage and the paper restricting roller 203. In the following description, this gap position is called a first stage coating roller gap position. Point D shows a gap position between the liquid coating roller 202*b* at the second stage and the paper restricting roller 204. In the following description, this gap position is called a second stage coating roller gap position. Point E shows a nipping position between the upper heating roller 305 and the offset belt 301 on the heating block in the toner separating unit 300. In the following description, this nipping position is called a nipping position of the toner separating unit. Distances between these points in this example are concretely set as follows. The distance between points A and B is set to 45 mm. The distance between points B and C is set to 50 mm. The distance between points C and D is set to 85 mm. The distance between points D and E is set to 108 mm.

Figure 16A:
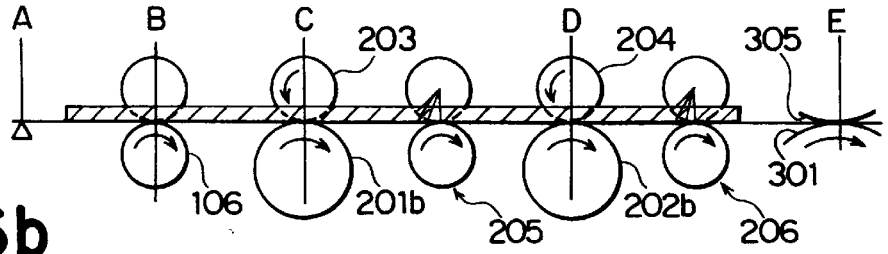

As shown in FIG. 16*a*, rotations of the coating rollers 201*b*, 202*b* and the paper restricting rollers 203, 204 are started long before a front end of a first transfer paper sheet 1 conveyed by the resist roller pair 106 reaches gaps between these coating and restricting rollers. Surfaces of the respective coating rollers 201*b* and 202*b* attain a state for stably forming a film of the processing liquid. At this time, all the rollers are rotated by controller 200 such that the transfer paper sheet 1 is conveyed onto a side of the toner separating unit 300. Circumferential speeds of the respective rollers are set as follows.

Resist roller pair: 20 mm/sec

Coating roller at first stage: setting speed ranging from 70 to 130 mm/sec

Paper restricting roller at first stage: the same speed as resist roller pair

Relay rubber roller at first stage:
- circumferential speed 1.025 times speed of resist roller pair Relay brush roller at first stage:
- circumferential speed 1.05 times speed of resist roller pair Coating roller at second stage: setting speed 45 mm/sec Paper restricting roller at second stage: the same speed as resist roller pair Relay rubber roller at second stage:
- circumferential speed 1.025 times speed of resist roller pair Relay brush roller at second stage:

circumferential speed 1.05 times speed of resist roller pair

Circumferential speeds of upper heating roller 305 and offset belt 301: the same speed as resist roller pair A timer is started when a rear end of the first transfer paper sheet is detected by the above paper sensor.

Figure 16B:
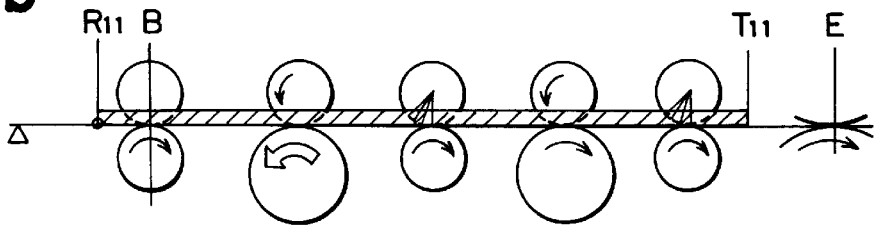

Thereafter, as shown in FIG. 16*b*, reverse rotation of the coating roller 201*b* at the first stage is started when a counting value of the above timer is equal to a counting value showing that the rear end of the first transfer paper sheet 1 reaches a point $R_{11}$ located by, e.g., 10 mm before the nipping position B of the resistor roller pair 106. A circumferential speed of this reverse rotation is equal to that of the above normal rotation. At this time point, a front end of the transfer paper sheet 1 reaches a position $T_{11}$ located by 7 mm before the nipping position E of the toner separating unit.

Figure 16C:
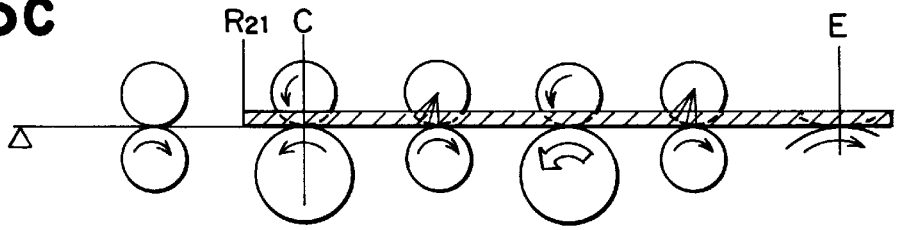

Thereafter, as shown in FIG. 16*c*, reverse rotation of the coating roller 202*b* at the second stage is started when the counting value of the above timer is equal to a counting value showing that the rear end of the first transfer paper sheet 1 reaches a point $R_{21}$ located by e.g., 10 mm before the first stage coating roller gap position C. A circumferential speed of this reverse rotation is also equal to that of the above normal rotation. At this time point, the front end of the transfer paper sheet 1 passes through the nipping position E of the toner separating unit.

Figure 16D:
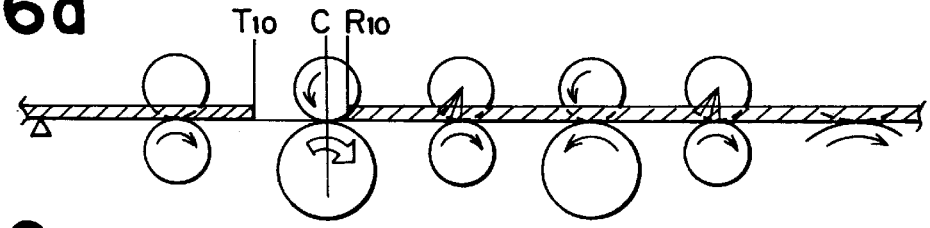

Thereafter, as shown in FIG. 16*d*, the rotation of the coating roller 201*b* at the first stage is reversed and the normal rotation of this coating roller 201*b* is restarted when the counting value of the above timer is equal to a counting value showing that the rear end of the first transfer paper sheet 1 reaches a point $R_{10}$ passing by e.g., 5 mm through the first stage coating roller gap position C. At this time point, a front end of a second transfer paper sheet 1 reaches a point $T_{10}$ located by 25 mm before the first stage coating roller gap position C.

Figure 16E:
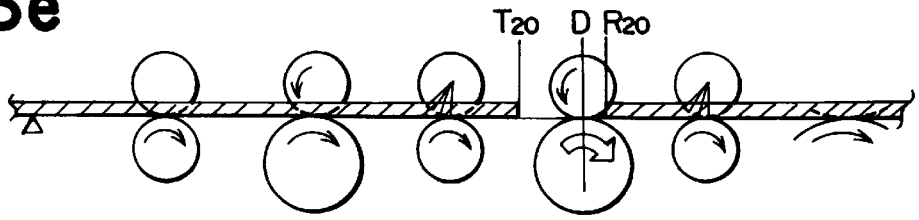

Thereafter, as shown in FIG. 16*e*, the rotation of the coating roller 201*b* at the second stage is reversed and the normal rotation of this coating roller 201*b* is restarted when the counting value of the above timer is equal to a counting value showing that the rear end of the first transfer paper sheet 1 reaches a point $R_{20}$ passing by e.g., 5 mm through the second stage coating roller gap position D. At this time point, the front end of the second transfer paper sheet 1 reaches a point $T_{20}$ located by 25 mm before the second stage coating roller gap position D.

Thereafter, the above timer is restarted when the rear end of the second transfer paper sheet 1 is detected by the above paper sensor. Similar to the first transfer paper sheet, the rotating directions of each of the coating rollers are then switched.

As mentioned above, in this embodiment, the rotation of the first stage coating roller 201*b* is switched to the reverse rotation just before the rear end of the transfer paper sheet 1 is separated from the nipping position of the resist roller pair 106 as shown in FIG. 16*b*. As shown in FIG. 16*d*, this reverse rotation is continued until the rear end of the transfer paper sheet 1 is separated from the first stage coating roller gap position C. Accordingly, after the rotation of the first stage coating roller 201*b* is switched to the reverse rotation, the rear end of the transfer paper sheet 1 is separated from the nipping position of the resist roller pair 106. The first stage coating roller 201*b* is continuously rotated reversely during a period in which rollers among the first stage coating roller 201*b* and the first stage paper restricting roller 203, the first stage relay roller pair 205, the second stage coating roller 202*b*, the second stage paper restricting roller 204, the upper heating roller 305 of the toner separating unit, etc. are opposed to a rearmost end portion of the transfer paper sheet as conveying members opposite to the transfer paper sheet 1. Accordingly, it is possible to prevent rapid traverse of the rear end of the transfer paper sheet caused by a high speed normal rotation of the first stage coating roller 201*b*.

As shown in FIG. 16*d*, the normal rotation of the first stage coating roller 201*b* is restarted before a front end portion of a subsequent transfer paper sheet 1 reaches the first stage coating roller gap position C. Thereafter, this normal rotation is continued until a rear end of this transfer paper sheet 1 is detected by the above paper sensor and reaches the position $R_{11}$ located just before the nipping position B of the resist roller pair shown in FIG. 16*b*. Accordingly, after the rotation of the first stage coating roller 201*b* is switched to this normal rotation, the front end of the transfer paper sheet passes through the first stage coating roller gap position C. The first stage coating roller 201*b* is continuously rotated normally during a period in which rollers among the first stage coating roller 201*b* and the first stage paper restricting roller 203, the first stage relay roller pair 205, the second stage coating roller 202*b*, the second stage paper restricting roller 204, the second stage relay roller pair 205, the upper heating roller 305 of the toner separating unit, etc. are opposed to a frontmost end portion of the transfer paper sheet as conveying members opposite to the transfer paper sheet 1. Accordingly, it is possible to prevent transfer folding and jam of the transfer paper sheet caused by return conveyance of the front end of the transfer paper sheet using the reverse rotation of the first stage coating roller 201*b*.

Further, as shown in FIG. 16*d*, the normal rotation of the first stage coating roller 201*b* is restarted long before the front end portion of the subsequent transfer paper sheet 1 reaches the first stage coating roller gap position C. Accordingly, the first stage coating roller 201*b* can receive the front end of this transfer paper sheet after a liquid film on the first stage coating roller 201*b* is changed from an unstable state to a stable state just after the reverse rotation of the first stage coating roller 201*b* is switched to the normal rotation. Therefore, the transfer paper sheet can be stably coated with the processing liquid from its front end.

As shown in FIG. 16*c*, the rotation of the second stage coating roller 202*b* is switched to the reverse rotation just before the rear end of the transfer paper sheet 1 is separated from the first stage coating roller gap position C. As shown in FIG. 16*e*, this reverse rotation is continued until the rear end of the transfer paper sheet is separated from the second stage coating roller gap position D. Accordingly, after the rotation of the second stage coating roller 202*b* is switched to the reverse rotation, the rear end of the transfer paper sheet is separated from the first stage coating roller gap position C. Thereafter, the second stage coating roller 202*b* is continuously rotated reversely during a period in which rollers among the second stage coating roller 202*b*, the second stage paper restricting roller 204, the second stage relay roller pair 205, the upper heating roller 305 of the toner separating unit, etc. are opposed to a rearmost end portion of the transfer paper sheet as conveying members opposite to the transfer paper sheet 1. Accordingly, it is possible to prevent rapid traverse of the rear end of the transfer paper sheet caused by a high speed normal rotation of the second stage coating roller 202*b*.

As shown in FIG. 16*e*, the normal rotation of the second stage coating roller 202*b* is restarted before a front end portion of a subsequent transfer paper sheet 1 reaches the second stage coating roller gap position D. Thereafter, this normal rotation is continued until a rear end of this transfer paper sheet 1 is detected by the above paper sensor and reaches the position $R_{21}$ located just before the first stage coating roller gap position C shown in FIG. 16*c*. Accordingly, after the rotation of the second stage coating roller 202*b* is switched to this normal rotation, the front end of the transfer paper sheet passes through the second stage coating roller gap position D. The second stage coating roller 202*b* is continuously rotated normally during a period in which rollers among the second stage coating roller 202*b*, the second stage paper restricting roller 204, the second stage relay roller pair 205, the upper heating roller 305 of the toner separating unit, etc. are opposed to a frontmost end portion of the transfer paper sheet as conveying members opposite to the transfer paper sheet 1. Accordingly, it is possible to prevent transfer folding and jam of the transfer paper sheet caused by return conveyance of the front end of the transfer paper sheet using the reverse rotation of the second stage coating roller 202*b*.

Further, as shown in FIG. 16*e*, the normal rotation of the second stage coating roller 202*b* is restarted long before the front end portion of the subsequent transfer paper sheet 1 reaches the second stage coating roller gap position D. Accordingly, the second stage coating roller 202*b* can receive the front end of this transfer paper sheet after a liquid film on the second stage coating roller 202*b* is changed from an unstable state to a stable state just after the reverse rotation of the second stage coating roller 202*b* is switched to the normal rotation. Therefore, the transfer paper sheet can be stably coated with the processing liquid from its front end.

In this embodiment, the operation of the resist roller pair 106 is controlled such that an interval of the transfer paper sheet continuously conveyed is constant. A switching operation of the normal and reverse rotations of each of the coating rollers is controlled in timing from a time point at which the rear end of the transfer paper sheet 1 is detected by the paper sensor. Accordingly, it is possible to cope with the transfer paper sheet of an arbitrary size by the same switching control of the normal and reverse rotations using a rear end position of the transfer paper sheet and a front end position of a subsequent transfer paper sheet separated from this rear end position at a predetermined interval.

In the toner removing apparatus shown in FIG. 14, the replenishment liquid bottle 208 and the processing liquid tank 210 are arranged below the above units 100, 200, 300, 400 and 500 and an operating section arranged in an upper surface portion of the toner removing apparatus. Concretely, each of the replenishment liquid bottle 208 and the processing liquid tank 210 is arranged in a lowermost portion of the toner removing apparatus. Accordingly, when a liquid is leaked from each of the replenishment liquid bottle 208 and the processing liquid tank 210, no leaked liquid drops into the respective units. Accordingly, different from a case in which the replenishment liquid bottle 208 and the processing liquid tank 210 are arranged above the respective units 100, 200, 300, 400 and 500, the following problems can be solved. Namely, it is possible to prevent the transfer paper sheet from being jammed by dropping of the leaked liquid onto a transfer paper sheet portion before the transfer paper sheet is fed into the liquid providing unit 200. It is also possible to prevent toner from being insufficiently separated partially from the transfer paper sheet by dropping of the leaked liquid onto a transfer paper sheet portion before the transfer paper sheet is fed into the toner separating unit 300. It is also possible to prevent the offset belt 301 from being insufficiently cleaned by dropping of the leaked liquid onto a portion of the cleaning brush 307 for the offset belt 301 in the toner separating unit 300. It is also possible to prevent the transfer paper sheet from being insufficiently dried and partially deformed with wrinkles, etc. by dropping of the leaked liquid onto the drying unit 400. Further, it is possible to prevent a sheet of regenerated paper from being dirtied, etc. by dropping of the leaked liquid onto the paper receiving unit 500.

The processing liquid tank 210 is arranged in a position lower than that of the liquid providing unit 200 so that the processing liquid is pumped up to the liquid providing unit 200 by the supplying pump 211. Accordingly, when an operation of this pump 211 is stopped by stoppage of the operation of the toner removing apparatus, etc., the processing liquid on a side of the liquid providing unit 200 can be freely collected into the processing liquid tank 210 by its empty weight. Accordingly, it is possible to prevent the processing liquid from being uselessly vapored from the processing liquid providing unit 200. It is also possible to prevent surfactant concentration of the processing liquid from being excessively increased by this vaporization.

In the toner removing apparatus shown in FIG. 14, filters 231 and 230 for filtering foreign matters mixed into the processing liquid are arranged within the above processing liquid tank 210 located within a circulating system of the processing liquid. The filters 231 and 230 are concretely arranged in a liquid sucking port portion 231 of the liquid supplying pump 211 and a discharging portion of the collecting pipe 214. These filters 231 and 230 catch foreign matters such as matters eluted from a paper sheet and paper powder mixed into the processing liquid through the liquid coating rollers 201*b* and 202*b* of the liquid providing unit 200, etc. The filters 231 and 230 can filter off these foreign matters from the circulated processing liquid. Accordingly, it is possible to prevent the foreign matters from being accumulated within the liquid containers 201*a* and 202*a* of the liquid providing unit 200 so that no foreign matters are attached and fixed onto surfaces of the liquid coating rollers 201*b* and 202*b*. Further, it is possible to prevent the processing liquid from being irregularly provided to the transfer paper sheet 1 and prevent pipes 213 and 214 from being clogged with the foreign matters. The foreign matters filtered off by the filters 230 and 231 can be removed therefrom when the toner removing apparatus is maintained. The filters 230 and 231 may be replaced with new ones.

In the example shown in FIG. 14, a transparent portion 240 is formed in the processing liquid tank 210 as shown by a chain line. Color of the interior processing liquid 2 and existence or nonexistence of a floating matter can be observed through this transparent portion 240. Accordingly, when the processing liquid 2 is dirtied and becomes musty and goes rotten, the internal processing liquid can be thrown away. Therefore, a discharging port for throwing the processing liquid into the processing liquid tank 210 may be arranged. Otherwise, a liquid discharging pipe may be connected to the processing liquid tank. The entire processing liquid tank 210 may be formed by a transparent member.

In the above embodiment, the present invention is applied to the transfer paper sheet 1 on which an image is formed by an electrophotographic copying machine of a transfer type. However, the present invention can be also applied to an image holding member such as a sheet of recording paper used in another image forming apparatus such as a facsimile telegraph, a printer, etc. The present invention is not limited to an image holding member having a fibrous structure. For example, the present invention can be applied to an image holding member on which an image can be formed. For example, the image holding member capable of applying the present invention thereto may be constructed by a laminated material, etc. in which a surface layer of a base sheet such as a plastic layer, etc. is a material layer of paper, etc.

In a tenth or thirteenth construction of the present invention, each of plural liquid supplying members arranged along a conveying path of a sheet material is endlessly moved at a high speed in a direction parallel to a conveying direction of the sheet material in at least a predetermined period. No liquid cutting is caused between the sheet material and each of the liquid supplying members. Further, while a sufficient amount of liquid is supplied to the sheet material by the plural liquid supplying members, each of the plural liquid supplying members is endlessly moved in a direction opposite to the conveying direction of the sheet material in at least a predetermined period in which there is a fear of rapid traverse of a rear end portion of the sheet material. Accordingly, while the liquid is preferably supplied to the sheet material, it is possible to prevent the sheet material from being folded and a supplied liquid amount from being insufficient by rapid traverse using the high speed endless movement with respect to the rear end portion of the sheet material.

In an eleventh or fourteenth construction of the present invention, each of the above plural liquid supplying members is endlessly moved at a speed higher than a moving speed of the sheet material in the direction parallel to the above conveying direction in at least a predetermined period in which there is a fear of feeding a front end portion of the sheet material onto an upstream side in the conveying direction in the endless movement in the above opposite direction. Accordingly, it is possible to prevent the sheet material from being folded and jammed by feeding the front end portion of the sheet material onto a downstream side in the conveying direction in the endless movement in the direction opposite to the conveying direction.

In a twelfth construction of the present invention, the endless movement of each of the plural liquid supplying members is started before a front end of the sheet material is opposed to a surface of each of the plural liquid supplying members. Accordingly, it is possible to prevent the sheet material from being opposed to the surface of each of the liquid supplying members and prevent the liquid from being irregularly provided to the sheet material in a period in which no liquid film is stabilized on the surface of each of the liquid supplying members just after the endless movement of each of the liquid supplying members is started.

In the toner removing apparatus shown in FIG. 14, one of the supporting rollers 302 and 303 such as the supporting roller 302 constitutes a drive supporting roller rotated by a motor of the toner removing apparatus body. This drive supporting roller 302 is constructed such that the drive supporting roller 302 can be manually rotated by uncoupling the drive supporting roller 302 from this motor. This construction will be described later in detail.

The next description relates to a detailed construction of the above toner separating unit 300 in which a drive supporting roller 302 can be manually rotated by uncoupling this drive supporting roller 302 from a motor side of a drive roller device body with reference to FIGS. 17*a* and 17*b*.

FIG. 17*a* is a view for explaining the schematic construction of a drive transmitting system of this drive supporting roller 302. FIG. 17*b* is a cross-sectional view taken along line X—X in FIG. 17*a*.

In FIG. 17*a*, a left-hand side corresponds to this side of a drive roller device and a right-hand side corresponds to a deep or coupling side of the drive roller device, etc. In this drive supporting roller 302, a roller portion 320 is hollow and bearings 321 and 322 are fixed by press-fitting, etc. to hollow internal portions of this roller portion 320 at both axial ends thereof. A slide shaft 323 is slidably supported by the bearings 321 and 322. A side end portion of this slide shaft 323 on this side of the drive roller device extends from the roller portion 320 onto this side of the drive roller device. An unillustrated knob is fixed to this extending portion of the slide shaft 323. An end portion of the slide shaft 323 on a deep side of the drive roller device extends from the roller portion 320 onto this deep side. A coupling 324 is fixed to this extending portion of the slide shaft 323 by fastening, etc. In the following description, this coupling 324 is called a slide coupling.

This slide coupling 324 has a roller side coupling portion 324*a* on this side of the drive roller device in an axial direction thereof. The roller side coupling portion 324*a* is coupled to a roller side coupling 325 fixed to an end portion of the roller portion 320 on the deep side of the drive roller device. The slide coupling 324 also has a body side coupling portion 324*b* on the deep side of the drive roller device in the axial direction. The body side coupling portion 324*b* is coupled to a body side coupling 326 operated by a motor, etc. arranged in a body of the drive roller device. Further, the slide coupling 324 has a partition flange portion 324*c* for partitioning both the coupling portions 324*a* and 324*b*. A sliding range of the slide coupling 324 is restricted by the body side coupling member 326 and the roller side coupling member 325 fixed to the roller portion 320.

As shown in FIG. 17*b*, a shape of the roller side coupling portion 324*a* of the slide coupling 324 and a shape of a coupling portion of the roller side coupling 325 coupled to this coupling portion 324*a* are formed such that rotating force can be transmitted between the slide coupling 324 and the roller side coupling 325 in any one of normal and reverse rotating directions of the drive roller device. This coupling portion of the roller side coupling 325 has a width in the axial direction sufficient to hold a coupling state to the slide coupling 324 in any sliding position in the above sliding range.

A sectional shape of the body side coupling portion 324*b* of the slide coupling 324 and a sectional shape of a coupling portion of the body side coupling member 326 coupled to this coupling portion 324*b* are set to the same shape as FIG. 17*b* such that rotating force can be transmitted between the slide coupling 324 and the body side coupling member 326 in any one of the normal and reverse rotating directions of the drive roller device. This coupling portion of the body side coupling member 326 is coupled to the body side coupling portion 324*b* of the slide coupling 324 only in a predetermined range of the above sliding range in which the slide shaft 323 is pushed in onto the deep side of the drive roller device. This coupling portion of the body side coupling member 326 has a narrow width in the axial direction set such that the slide coupling 324 and the body side coupling member 326 are uncoupled from each other when the coupling portion of the body side coupling member 326 is pulled out on this side of the drive roller device from this predetermined range.

In the above construction, the slide shaft 323 is located in a sliding position in a normal state in which the drive supporting roller 302 can be rotated by transmitting rotation of the body side coupling member 326. In this sliding position, the body side coupling member 326 and the body side coupling portion 324*b* of the slide coupling 324 fixed to the slide shaft 323 can be coupled to each other. In this normal state, the body side coupling member 326 and the body side coupling portion 324*b* of the slide coupling 324 can be coupled to each other. Further, in this normal state, the roller side coupling portion 324*a* of the slide coupling 324 and the roller side coupling member 325 fixed to the roller portion 320 of the drive supporting roller 302 are coupled to each other. Thus, rotation of the body side coupling member 326 is transmitted to the roller portion 320 through the slide coupling 324 so that the drive supporting roller 302 can be rotated.

When the drive supporting roller 302 is manually rotated, the slide shaft 323 is slid until a sliding position on this side of the drive roller device in which the slide shaft 323 and the body side coupling member 326 are uncoupled from each other. Thus, the body side coupling member 326 and the body side coupling portion 324*b* of the slide coupling 324 are uncoupled from each other. In this state, the roller side coupling portion 324*a* of the slide coupling 324 is still coupled to the roller side coupling member 325 fixed to the roller portion 320. Accordingly, the slide shaft 323 is manually rotated in this sliding position so that the drive supporting roller 302 can be manually rotated.

Figure 18A:
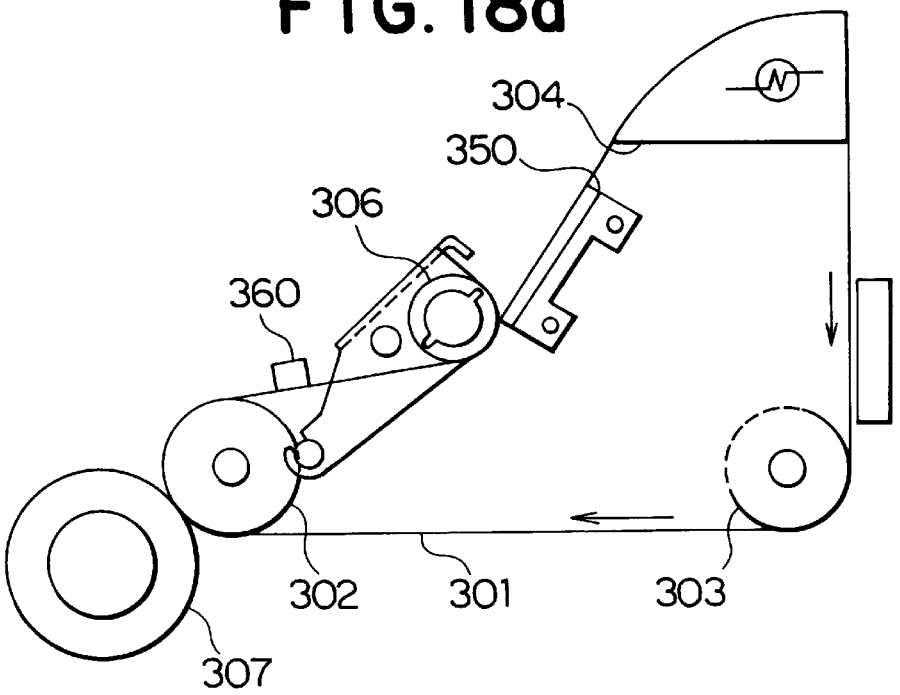
Figure 18B:
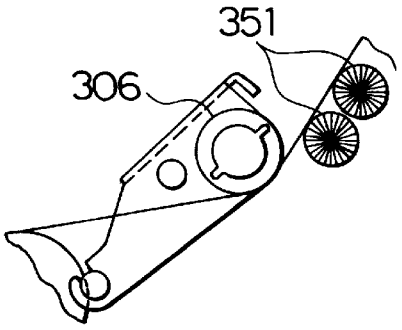
Figure 18C:
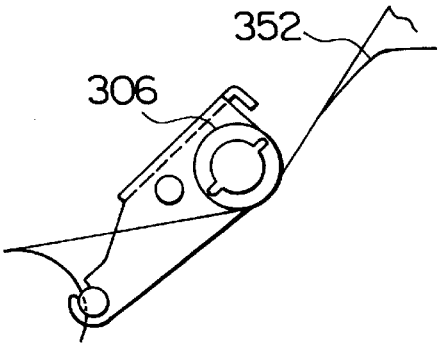

In the above toner removing apparatus shown in FIG. 14, a front face of the offset belt 301 is cleaned by the cleaning brush 307, but it is also desirable to clean a rear face of this offset belt 301 for the following reasons. Namely, there is a case in which toner and dust removed from the front face of the offset belt 301 by this cleaning and floating in the air are attached to the rear face of the offset belt 301. When the toner and the dust are attached to the rear face of the offset belt 301, a driving load of the drive supporting roller 302 is increased with the passage of time and durability of the offset belt 301 is reduced since the toner, etc. are adhered to surfaces of the supporting rollers 302 and 303, etc. and sliding resistance between the offset belt 301 and a surface of the heating block 304 is increased. For example, as shown in FIG. 18*a*, the rear face of the offset belt 301 is cleaned by using a felt 350 arranged such that the felt 350 comes in contact with this rear face. As shown in FIG. 18*b*, the rear face of the offset belt 301 can be also cleaned by using brush rollers 351 coming in slide contact with this rear face. As shown in FIG. 18*c*, the rear face of the offset belt 301 can be also cleaned by using a scraping blade 352 in which a front end of this blade 352 comes in contact with this rear face and scrapes off attached matters on this rear face.

Figure 18D:
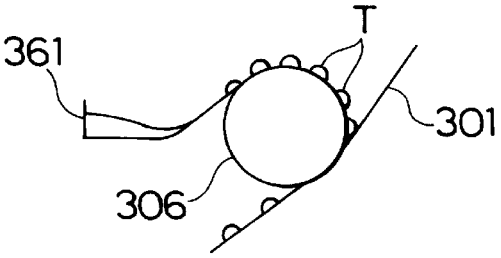

In the toner removing apparatus shown in FIG. 14, the offset belt 301 is frictionally slid by the cleaning brush 307 and the rear face of the offset belt 301 is frictionally slid by the surface of the heating block 304. Therefore, the offset belt 301 is charged with electricity by friction, etc. Such charged belt 301 tends to attract floating matters in the air as mentioned above and attach the floating matters onto a surface of this belt. When this attachment is caused on the front face of this belt 301 for toner separation, toner separating performance of the offset belt 301 is reduced. Therefore, it is desirable to arrange a means for discharging the offset belt 301. The discharging means can use various kinds of constructions. For example, as shown in FIG. 18*a*, the discharging means can be constructed by using a discharging member 360 composed of a discharging brush, etc. coming in contact with the front face of the offset belt 301. Further, as shown in FIG. 18*d*, the discharging means may be constructed such that a tension roller 306 is constructed by a conductor and the offset belt 301 is discharged by applying a voltage to this tension roller 306. Further, a voltage for transferring attached matters T onto the front face of the offset belt 301 to the tension roller 306 may be used as the voltage applied to the tension roller 306. In this case, the toner removing apparatus may have a collecting container 361 for scraping the attached matters T from the front face of the tension roller 306 and collecting the attached matters T. Instead of such voltage application, a contact member may be formed on the front face of the offset belt 301 such that this contact member has the same polarity as a charging polarity of the offset belt 301 in frictional charging between the contact member and the offset belt 301, and a surface of this contact member is formed by a material frictionally charged strongly in comparison with the offset belt 301. In this case, the attached matters on the offset belt 301 are transferred onto the tension roller 306 by charges caused by this frictional charging.

In accordance with the present invention, the interior of a drive roller is hollow and a slide shaft slid within this hollow interior is used. In a normal state, rotation of a driving input member is transmitted to the drive roller so as to rotate the drive roller. In another operating state, the slide shaft and the driving input member are uncoupled from each other while the slide shaft and the drive roller are coupled to each other. In this another operating state, the drive roller can be rotated by a manual rotation of the slide shaft, etc. These states are switched in accordance with a sliding position of the slide shaft. Accordingly, drive transmitting systems can be coupled and uncoupled between the drive roller and the driving input member on the driving side of a drive roller device body without sliding the drive roller itself. Further, the slide shaft is stored into the hollow interior of the drive roller so that no drive roller device is large-sized in cross section perpendicular to a shaft of the drive roller.

Many widely different embodiments of the present invention may be constructed without departing from the spirit and scope of the present invention. It should be understood that the present invention is not limited to the specific embodiments described in the specification, except as defined in the appended claims.

What is claimed is:

1. A method for removing an image forming substance attached to a surface of an image holding member so that the image holding member may be reused, comprising the steps of:

supplying an unstabilizing liquid for unstabilizing a stable adhesive force between said image holding member and said image forming substance in a plurality of supply stages, a total amount of said unstabilizing liquid supplied in all of said unstabilizing liquid supply stages being a predetermined amount; and separating said image forming substance from said image holding member in at least one separating step, wherein all said at least one separating steps comprise transferring said image forming substance unstabilized by said unstabilizing liquid supplied in said plurality of supply stages to a separating member, said separating member having adhesive force with respect to said image forming substance on said image holding member which is stronger than said unstabilized adhesive force between said image holding member and said image forming substance.

2. A method for removing an image forming substance as claimed in claim 1, wherein a concentration of said unstabilizing liquid sequentially increases in said plurality of unstabilizing liquid supply stages.

3. A method for removing an image forming substance as claimed in claim 1, wherein said predetermined amount of unstabilizing liquid is an allowable limit amount for which said image holding member may extend as said unstabilizing liquid is supplied.

4. An apparatus for removing an image forming substance from an image holding member in which the image forming substance is attached to a surface of the image holding member so that the image holding member may be reused, comprising:

a first unstabilizing liquid supply member supplying a first unstabilizing liquid for unstabilizing the adhesive force between said image holding member and said image forming substance, said first unstabilizing liquid expanding at least a medium forming the surface of said image holding member on which said image forming substance attaches; and a second unstabilizing liquid supply member supplying a second unstabilizing liquid to said image holding member, said second unstabilizing liquid further expanding said medium expanded by said first unstabilizing liquid and unstabilizing the adhesive force between said image holding member and said image forming substance and at least one separating device having an adhesive force with respect to said image forming substance stronger than said unstabilized adhesive force between said further expanded medium forming the surface of said image holding member and said image forming substance, all of said at least one separating members being engageable with said image forming substance for separating said image forming substance unstabilized by said first and second unstabilizing liquids from said image holding member, thereby transferring said image forming substance from said image holding member to said separating device.

5. An image forming substance removing apparatus as claimed in claim 4, wherein at least one of said unstabilizing liquid supply members has plural sets of coating rollers and restricting rollers, wherein a film of said unstabilizing liquid formed on the surface of each of the coating rollers may be provided to the image holding member, and wherein each of the restricting rollers is opposed to of the coating rollers through the image holding member and restricts a movement of the image holding member in a thickness direction thereof.

6. An image forming substance removing apparatus as claimed in claim 5, wherein said coating rollers and said restricting rollers are arranged such that the coating and restricting rollers are opposed to each other at predetermined intervals; and surfaces of both the coating and restricting rollers are constructed by a material having an affinity for the unstabilizing liquid.

7. An image forming substance removing apparatus as claimed in claim 4, wherein at least one of said unstabilizing liquid supply members comprises a supersonic wave oscillating member for changing the unstabilizing liquid to a mist to be provided to the image holding member.

8. An image forming substance removing apparatus as claimed in claim 7, wherein said supersonic wave oscillating member has a mist generating portion, further comprising an image holding member moving device relatively moving the image holding member with respect to the mist generating portion of said supersonic wave oscillating member; and supersonic wave oscillating control member starting oscillation of said supersonic wave oscillating member when the image holding member approaches the mist generating portion.

9. An image forming substance removing apparatus as claimed in claim 4, wherein at least one of said unstabilizing liquid supply members is constructed such that the unstabilizing liquid is provided to the image holding member from both front and rear face sides thereof.

10. An image forming substance removing apparatus as claimed in claim 4, wherein an aqueous solution including at least a surfactant is used as said unstabilizing liquid; and said first and second unstabilizing liquids have different surfactant concentrations with respect to each other, and the surfactant concentration of said first unstabilizing liquid is lower than that of said second unstabilizing liquid.

11. An image forming substance removing apparatus as claimed in claim 10, wherein the surfactant concentration of said second unstabilizing liquid is higher than that of said first unstabilizing liquid.

12. An image forming substance removing apparatus as claimed in claim 4, wherein an absorbing speed of said first unstabilizing liquid into said image holding member in said first unstabilizing liquid supply member is slower than that in said second unstabilizing liquid supply member.

13. An image forming substance removing apparatus as claimed in claim 4, wherein an amount of said first unstabilizing liquid absorbed into said image holding member in said first unstabilizing liquid supply member is lower than that in said second unstabilizing liquid supply member.

14. An apparatus for removing an image forming substance from a surface of a sheet material on which the image forming substance is fixed;

the removing apparatus comprising:

first and second supporting conveyers arranged at a predetermined interval along a conveying path of the sheet material and supporting the sheet material in a thickness direction thereof and conveying the sheet material in a predetermined direction;

a liquid supplying device having plural liquid supplying members each arranged between the first and second supporting conveyers in the conveying path and carrying a liquid on its surface;

the liquid supplying members being operated such that each of the liquid supplying members is endlessly moved selectively in a direction parallel to a conveying direction of the sheet material using the first and second supporting conveyers and a direction opposite to this conveying direction;

liquid supplying member driving control means constructed such that each of said plural liquid supplying members is endlessly moved in a predetermined period at a speed higher than a moving speed of the sheet material in the direction parallel to said conveying direction, and each of said plural liquid supplying members is endlessly moved in the direction opposite to said conveying direction in at least a period corresponding to a liquid supplying member opposed to a rearmost end portion of the sheet material among liquid supplying members for providing conveying force to the sheet material conveyed in the predetermined direction; and image forming substance removing means for removing the image forming substance from the sheet material to which the liquid is supplied by the liquid supplying device.

15. An image forming substance removing apparatus as claimed in claim 14, wherein said liquid supplying member driving control means is constructed such that each of said plural liquid supplying members is endlessly moved at a speed higher than the moving speed of the sheet material in the direction parallel to said conveying direction in at least a period corresponding to a liquid supplying member opposed to a frontmost end portion of the sheet material among liquid supplying members for providing conveying force to the sheet material conveyed in the predetermined direction.

16. An image forming substance removing apparatus as claimed in claim 14 or 15, wherein said liquid supplying member driving control means is constructed such that the endless movement of each of said plural liquid supplying members is started before a front end of the sheet material is opposed to a surface of each of said plural liquid supplying members.

17. A sheet material processor for supplying a liquid to a sheet material and performing predetermined processing with respect to this sheet material;

the sheet material processor comprising:

first and second supporting conveyers arranged at a predetermined interval along a conveying path of the sheet material and supporting the sheet material in a thickness direction thereof and conveying the sheet material;

a liquid supplying device having plural liquid supplying members each arranged between the first and second supporting conveyers in the conveying path and carrying a liquid on its surface;

the liquid supplying members being operated such that each of the liquid supplying members is endlessly moved selectively in a direction parallel to a conveying direction of the sheet material using the first and second supporting conveyers and a direction opposite to this conveying direction; and liquid supplying member driving control means constructed such that each of said plural liquid supplying members is endlessly moved in a predetermined period at a speed higher than a moving speed of the sheet material in the direction parallel to said conveying direction, and each of said plural liquid supplying members is endlessly moved in the direction opposite to said conveying direction in at least a period corresponding to a liquid supplying member opposed to a rearmost end portion of the sheet material among liquid supplying members for providing conveying force to the sheet material conveyed in a predetermined direction.

18. A sheet material processor as claimed in claim 17, wherein said liquid supplying member driving control means is constructed such that each of said plural liquid supplying members is endlessly moved at a speed higher than the moving speed of the sheet material in the direction parallel to said conveying direction in at least a period corresponding to a liquid supplying member opposed to a frontmost end portion of the sheet material among liquid supplying members for providing conveying force to the sheet material conveyed in the predetermined direction.

19. An apparatus for removing an image forming substance from an image holding member in which the image forming substance is attached to a surface of the image holding member, so that the image holding member may be reused, comprising:

a first unstabilizing liquid supply member supplying a first unstabilizing liquid for unstabilizing the adhesive force between said image holding member and said image forming substance, said first unstabilizing liquid expanding at least a medium forming the surface of said image holding member on which said image forming substance attaches; and a second unstabilizing liquid supply member supplying a second unstabilizing liquid to said image holding member, said second unstabilizing liquid further expanding said medium expanded by said first unstabilizing liquid and unstabilizing the adhesive force between said image holding member and said image forming substance and at least one separating device having an adhesive force with respect to said image forming substance stronger than said unstabilized adhesive force between said further expanded medium forming the surface of said image holding member and said image forming substance, all of said at least one separating devices being engageable with said image forming substance for separating said image forming substance unstabilized by said first and second unstabilizing liquids from said image holding member, thereby transferring said image forming substance from said image holding member to said separating device.

20. An apparatus for removing an image forming substance from an image holding member to a surface of which the image forming substance is attached, so that the image holding member may be reused, comprising:

a first unstabilizing substance supply member supplying an unstabilizing substance to said image holding member;

a second unstabilizing substance supply member supplying an unstabilizing substance to the image holding member, an amount of supply of the unstabilizing substance being such an amount as to unstabilize a stable adhesive force between said image holding member and said image forming substance; and at least one separating device, all of said at least one separating devices having an adhesive force with respect to said image forming substance stronger than said unstabilized adhesive force between said further expanded image holding member and said image forming substance unstabilized by said first and second unstabilizing liquids and engageable with said image forming substance for separating said image forming substance from said image holding member, thereby transferring said image forming substance from said image holding member to said separating member.

21. An image forming substance removing apparatus as claimed in claim 20, wherein at least one of the first and second unstabilizing substances is an unstabilizing liquid.

22. An image forming substance removing apparatus as claimed in claim 20 or 21, wherein the unstabilizing substance supplied by said second unstabilizing substance supply member has at least one of the following properties:

(1) concentration of the unstabilizing substance supplied by said second unstabilizing substance supply member is higher than that of the unstabilizing substance supplied by said first unstabilizing substance supply member, (2) absorbing speed of the unstabilizing substance supplied by said second unstabilizing substance supply member into said image holding member is slower than that of the unstabilizing substance supplied by said first unstabilizing substance supply member into said image holding member, and (3) an amount of the unstabilizing substance supplied by said second unstabilizing substance supply member absorbed into said image holding member is lower than that of the unstabilizing substance supplied by said first unstabilizing substance supply member absorbed into said image holding member.

23. An image forming substance removing apparatus as claimed in claim 20 or 21, wherein the adhesive force between said image holding member and said image forming substance attached to the surface of the image holding member is lowered as said unstabilizing substance is supplied;

a predetermined amount of supply of said unstabilizing substance is separately supplied by said first unstabilizing substance supply member and said second unstabilizing substance supply member, said predetermined amount being sufficient for unstabilizing the adhesive force between said image holding member and said image forming substance.

24. An apparatus for removing an image forming substance from an image holding member in which the image forming substance is attached to a surface of the image holding member, so that the image holding member may be reused, comprising:

a supplier supplying a predetermined amount of an unstabilizing substance to said image holding member in a plurality of stages, said predetermined amount being sufficient for unstabilizing stable adhesive force between said image holding member and said image forming substance; and at least one separating device separating said image forming substance from said image holding member by contacting said image forming substance with a separating member, all of said at least one separating devices having an adhesive force stronger than said unstabilized adhesive force between said image holding member and said image forming substance unstabilized by the unstabilizing substance supplied in said plurality of stages, thereby transferring said image forming substance from said image holding member to said separating member.

25. An image forming substance removing apparatus as claimed in claim 24, wherein said supplier comprises at least two supply members, wherein a total amount of said unstabilizing substance supplied by said supply members is sufficient for unstabilizing stable adhesive force between said image holding member and said image forming substance.

26. An apparatus for removing an image forming substance from an image holding member in which the image forming substance is attached to a surface of the image holding member, so that the image holding member may be reused comprising:

a supply device supplying a predetermined amount of an unstabilizing substance to said image holding member in a plurality of stages for unstabilizing a stable adhesive force between said image holding member and said image forming substance; and at least one separating device separating said image forming substance from said image holding member by contacting said image forming substance with a separating member, all of said at least one separating devices having an adhesive force with said image forming substance stronger than said unstabilized adhesive force between said image holding member and said image forming substance, as unstabilized by the unstabilizing substance supplied in said plurality of stages, thereby transferring said image forming substance from said image holding member to said separating member.

27. An apparatus for removing an image forming substance from an image holding member in which the image forming substance is attached to a surface of the image holding member so that the image holding member may be reused, comprising:

a first unstabilizing liquid supply device supplying a first unstabilizing liquid for unstabilizing the adhesive force between said image holding member and said image forming substance, said first unstabilizing liquid expanding at least a medium forming the surface of said image holding member on which said image forming substance attaches; and a second unstabilizing liquid supply device supplying a second unstabilizing liquid to said image holding member, said second unstabilizing liquid further expanding said medium expanded by said first unstabilizing liquid and unstabilizing the adhesive force between said image holding member and said image forming substance; and at least one separating device, all of said at least one separating devices having an adhesive force with respect to said image forming substance stronger than said unstabilized adhesive force between said further expanded image holding member and said image forming substance, as unstabilized by said first and second unstabilizing liquids, each said at least one separating device being engageable with said image forming substance for separating said image forming substance from said image holding member, thereby transferring said image forming substance from said image holding member to said separating device.

28. An apparatus for removing an image forming substance from a surface of a sheet material on which the image forming substance is fixed so that the sheet material may be reused, the removing apparatus comprising:

first and second supporting conveyers arranged at a predetermined interval along a conveying path of the sheet material and supporting the sheet material in a thickness direction thereof and conveying the sheet material in a predetermined direction;

a liquid supplying device having plural liquid supplying members each arranged between the first and second supporting conveyers in the conveying path and carrying a liquid on its surface;

the liquid supplying members being operated such that each of the liquid supplying members is endlessly moved selectively in a direction parallel to a conveying direction of the sheet material using the first and second supporting conveyers and a direction opposite to this conveying direction;

liquid supplying member driving control device constructed such that each of said plural liquid supplying members is endlessly moved in a predetermined period at a speed higher than a moving speed of the sheet material in the direction parallel to said conveying direction, and each of said plural liquid supplying members is endlessly moved in the direction opposite to said conveying direction in at least a period corresponding to a liquid supplying member opposed to a rearmost end portion of the sheet material among liquid supplying members for providing conveying force to the sheet material conveyed in the predetermined direction; and at least one image forming substance removing device, all of said at least one image forming substance removing devices being provided for removing the image forming substance from the sheet material to which the liquid is supplied by the liquid supplying device.

29. A sheet material processor for supplying a liquid to a sheet material and performing predetermined processing with respect to this sheet material so that the sheet material may be reused;

the sheet material processor comprising:

first and second supporting conveyers arranged at a predetermined interval along a conveying path of the sheet material and supporting the sheet material in a thickness direction thereof and conveying the sheet material;

a liquid supplying device having plural liquid supplying members each arranged between the first and second supporting conveyers in the conveying path and carrying a liquid on its surface;

the liquid supplying device being operated such that each of the liquid supplying members is endlessly moved selectively in a direction parallel to a conveying direction of the sheet material using the first and second supporting conveyers and a direction opposite to this conveying direction; and a liquid supplying member driving control device constructed such that each of said plural liquid supplying members is endlessly moved in a predetermined period at a speed higher than a moving speed of the sheet material in the direction parallel to said conveying direction, and each of said plural liquid supplying members is endlessly moved in the direction opposite to said conveying direction in at least a period corresponding to a liquid supplying member opposed to a rearmost end portion of the sheet material among liquid supplying members for providing conveying force to the sheet material conveyed in a predetermined direction.

30. An apparatus for removing an image forming substance from an image holding member in which the image forming substance is attached to a surface of the image holding member, so that the image holding member may be reused, comprising:

a first unstabilizing liquid supply device supplying a first unstabilizing liquid for unstabilizing the adhesive force between said image holding member and said image forming substance, said first unstabilizing liquid expanding at least a medium forming the surface of said image holding member on which said image forming substance attaches; and a second unstabilizing liquid supply device supplying a second unstabilizing liquid to said image holding member, said second unstabilizing liquid further expanding said medium expanded by said first unstabilizing liquid and unstabilizing the adhesive force between said image holding member and said image forming substance, at least one separating device having an adhesive force with respect to said image forming substance stronger than said unstabilized adhesive force between said further expanded image holding member and said image forming substance, all of said at least one separating devices being engageable with said image forming substance unstabilized by said first and second unstabilizing liquids for separating said image forming substance from said image holding member, thereby transferring said image forming substance from said image holding member to said separating device.

31. An apparatus for removing an image forming substance from an image holding member to a surface of which the image forming substance is attached, so that the image holding member may be reused, comprising:

a first unstabilizing substance supply device supplying an unstabilizing substance to said image holding member;

a second unstabilizing substance supply device supplying an unstabilizing substance to the image holding member, an amount of supply of the unstabilizing substance being such an amount as to unstabilize a stable adhesive force between said image holding member and said image forming substance; and at least one separating device having an adhesive force with respect to said image forming substance stronger than said unstabilized adhesive force between said further expanded image holding member and said image forming substance, all of said at least one separating devices being engageable with said image forming substance for separating said image forming substance, as unstabilized by said first and second unstabilizing substance supply devices, from said image holding member, thereby transferring said image forming substance from said image holding member to said separating device.

32. An apparatus for removing an image forming substance from an image holding material in which the image forming substance is attached to a surface of the image holding material so that the image holding material may be reused, comprising:

a supply unit supplying an unstabilizing liquid for unstabilizing a stable adhesive force between said image holding material and said image forming substance, said supply unit having a first supply member and a second supply member supplying at least said unstabilizing liquid to at least said image holding material, and a transferring member transferring said image holding material from said first supply member to said second supply member, each of said first supply member and said second supply member having a liquid container containing said unstabilizing liquid, a coating roller providing said unstabilizing liquid to said image holding material from said liquid container, and a restricting roller facing said coating roller with said image holding material between, a total amount of said unstabilizing liquid supplied by said first supply member and said second supply member being a predetermined amount of said unstabilizing liquid to said image holding material;

at least one separating belt, all of said at least one separating belts having an adhesive force with respect to said image forming substance stronger than said unstabilized adhesive force between said image holding material and said image forming substance, unstabilized by said unstabilizing liquid supplied by said first supply member and said second supply member;

a supporting roller driving said separating belt rotatively;

a separating unit having a heating member softening or melting at least said image forming substance; and a transferring roller transferring said image holding material to said separating unit from said supply unit.

33. An image forming substance removing apparatus as claimed in claim 32, wherein a distance between said coating roller and said restricting roller of said first supply member is longer than a thickness of said image holding material, said unstabilizing liquid supplied by said coating roller is supplied to said restricting roller, and a film of said unstabilizing liquid can be formed between said coating roller and said restricting roller.

34. An image forming substance removing apparatus as claimed in claim 33, wherein a distance between said coating roller and said restricting roller of said second supply member is longer than that of said first supply member.

35. An image forming substance removing apparatus as claimed in claim 32 or 33, wherein the distance between said coating roller and said restricting roller of said second supply member is longer than the thickness of said image holding material supplied said unstabilizing liquid by said first supply member.

36. An image forming substance removing apparatus as claimed in claim 32, wherein at least a surface of said coating roller has an affinity for said unstabilizing liquid supplied to said image holding material.

37. An image forming substance removing apparatus as claimed in claim 32, wherein said coating roller or said restricting roller is also used for said transferring member for transferring said image holding material from said first supply member to said second supply member.

* * * * *